US009372418B2

(12) United States Patent
Shida et al.

(10) Patent No.: US 9,372,418 B2
(45) Date of Patent: Jun. 21, 2016

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Kazuhisa Shida, Kawasaki (JP); Atsushi Fujii, Yokohama (JP); Haruyuki Tsuji, Yokohama (JP); Nobuhiro Nakamura, Numazu (JP); Hideaki Matsuoka, Mishima (JP); Hiroyuki Tomono, Numazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/418,861

(22) PCT Filed: Aug. 29, 2013

(86) PCT No.: PCT/JP2013/073861
§ 371 (c)(1),
(2) Date: Jan. 30, 2015

(87) PCT Pub. No.: WO2014/034961
PCT Pub. Date: Mar. 6, 2014

(65) Prior Publication Data

US 2015/0212437 A1 Jul. 30, 2015

(30) Foreign Application Priority Data

Aug. 30, 2012 (JP) ..... 2012-189530
Apr. 3, 2013 (JP) ..... 2013-077620

(51) Int. Cl.
*G03G 15/04* (2006.01)
*G03G 5/087* (2006.01)
*G03G 5/00* (2006.01)
*G03G 5/14* (2006.01)

(52) U.S. Cl.
CPC ..... *G03G 5/087* (2013.01); *G03G 5/00* (2013.01); *G03G 5/142* (2013.01); *G03G 5/144* (2013.01)

(58) Field of Classification Search
CPC ..... G03G 5/087; G03G 5/144; G03G 5/142
USPC ..... 430/56, 57.1, 62, 69
See application file for complete search history.

(56) References Cited

U.S. PATENT DOCUMENTS 6,136,484 A * 10/2000 Katayama ..... G03G 5/0696 430/131
6,168,911 B1 1/2001 Lelental et al.
(Continued)

FOREIGN PATENT DOCUMENTS

EP 1 870 774 A1 12/2007
EP 2 317 393 A1 5/2011
JP 6-207118 A 7/1994
JP 9-50142 A 2/1997
(Continued)

OTHER PUBLICATIONS

International Search Report and Written Opinion of the International Searching Authority, International Application No. PCT/JP2013/073861, Mailing Date Oct. 15, 2013.
European Search Report dated Mar. 8, 2016 in European Application No. 13832737.4.

*Primary Examiner* — Thorl Chea
(74) *Attorney, Agent, or Firm* — Fitzpatrick, Cella, Harper and Scinto

(57) ABSTRACT

An electrophotographic photosensitive member in which a leak hardly occurs, and a process cartridge and electrophotographic apparatus having the same are provided. The conductive layer in the electrophotographic photosensitive member includes a binder material, a first metal oxide particle, and a second metal oxide particle. The first metal oxide particle is a titanium oxide particle coated with tin oxide doped with phosphorus, tungsten, niobium, tantalum, or fluorine, and the second metal oxide particle is an uncoated titanium oxide particle. The contents of the first and second metal oxide particles in the conductive layer is 20 to 50 vol. % and 1.0 to 15 vol. %, respectively based on the total volume of the conductive layer. The content of the second metal oxide particle in the conductive layer is 5.0 to 30% by volume based on the content of the first metal oxide particle in the conductive layer.

5 Claims, 3 Drawing Sheets

(56) References Cited

U.S. PATENT DOCUMENTS

| | | | | |
|---|---|---|---|---|
| 7,344,810 | B2 | 3/2008 | Ito et al. | |
| 8,778,580 | B2 | 7/2014 | Tsuji et al. | |
| 2008/0124641 | A1 | 5/2008 | Toriyama et al. | |
| 2012/0114375 | A1 | 5/2012 | Fujii et al. | |
| 2012/0225381 | A1* | 9/2012 | Nakamura | G03G 5/144 430/131 |

FOREIGN PATENT DOCUMENTS

| | | | |
|---|---|---|---|
| JP | 2000-231178 | A | 8/2000 |
| JP | 2004-349167 | A | 12/2004 |
| JP | 2008-26482 | A | 2/2008 |
| JP | 2012-18370 | A | 1/2012 |
| JP | 2012-18371 | A | 1/2012 |
| WO | 2011/027911 | A1 | 3/2011 |

* cited by examiner

ELECTROPHOTOGRAPHIC PHOTOSENSITIVE MEMBER, PROCESS CARTRIDGE, AND ELECTROPHOTOGRAPHIC APPARATUS

TECHNICAL FIELD

The present invention relates to an electrophotographic photosensitive member, a process cartridge and electrophotographic apparatus having an electrophotographic photosensitive member.

BACKGROUND ART

Recently, research and development of electrophotographic photosensitive members (organic electrophotographic photosensitive members) using an organic photoconductive material have been performed actively.

The electrophotographic photosensitive member basically includes a support and a photosensitive layer formed on the support. Actually, however, in order to cover defects of the surface of the support, protect the photosensitive layer from electrical damage, improve charging properties, and improve charge injection prohibiting properties from the support to the photosensitive layer, a variety of layers is often provided between the support and the photosensitive layer.

Among the layers provided between the support and the photosensitive layer, as a layer provided to cover defects of the surface of the support, a layer containing metal oxide particles is known. The layer containing a metal oxide particle usually has a higher conductivity than that of the layer containing no metal oxide particle (for example, volume resistivity of $1.0\times10^{8}$ to $5.0\times10^{12}$ Ω·cm). Thus, even if the film thickness of the layer is increased, residual potential is hardly increased at the time of forming an image, and dark potential and bright potential hardly fluctuate. For this reason, the defects of the surface of the support are easily covered. Such a highly conductive layer (hereinafter, referred to as a "conductive layer (electrically conductive layer)") is provided between the support and the photosensitive layer to cover the defects of the surface of the support. Thereby, the tolerable range of the defects of the surface of the support is wider. As a result, the tolerable range of the support to be used is significantly wider, leading to an advantage in that productivity of the electrophotographic photosensitive member can be improved.

Patent Literature 1 discloses a technique for containing a titanium oxide particle coated with tin oxide doped with phosphorus, tungsten, or fluorine in a conductive layer provided between a support and a photosensitive layer.

Patent Literature 2 discloses a technique for containing a titanium oxide particle coated with tin oxide doped with phosphorus or tungsten in a conductive layer provided between a support and a photosensitive layer.

CITATION LIST

Patent Literature

PTL 1: Japanese Patent Application Laid-Open No. 2012-018370

PTL 2: Japanese Patent Application Laid-Open No. 2012-018371

SUMMARY OF INVENTION

Technical Problem

Unfortunately, examination by the present inventors revealed that if a high voltage is applied to an electrophotographic photosensitive member using such a layer containing a titanium oxide particle coated with tin oxide doped with phosphorus, tungsten, niobium, tantalum, or fluorine as a conductive layer under a low temperature and low humidity environment, a leak easily occurs in the electrophotographic photosensitive member. The leak is a phenomenon such that a portion of the electrophotographic photosensitive member locally breaks down, and an excessive current flows through the portion. If the leak occurs, the electrophotographic photosensitive member cannot be sufficiently charged, leading to image defects such as black dots, horizontal white stripes and horizontal black stripes formed on an image. The horizontal white stripes are white stripes that appear on an output image in the direction corresponding to the direction intersecting perpendicular to the rotational direction (circumferential direction) of the electrophotographic photosensitive member. The horizontal black stripes are black stripes that appear on an output image in the direction corresponding to a direction intersecting perpendicular to the rotational direction (circumferential direction) of the electrophotographic photosensitive member.

The present invention is directed to providing an electrophotographic photosensitive member in which a leak hardly occurs even if a layer containing a titanium oxide particle coated with tin oxide doped with phosphorus, tungsten, niobium, tantalum, or fluorine as a metal oxide particle is used as a conductive layer in the electrophotographic photosensitive member, and a process cartridge and electrophotographic apparatus having the electrophotographic photosensitive member.

Solution to Problem

According to one aspect of the present invention, there is provided an electrophotographic photosensitive member including a support, a conductive layer formed on the support, and a photosensitive layer formed on the conductive layer, wherein the conductive layer includes a binder material, a first metal oxide particle, and a second metal oxide particle, the first metal oxide particle is a titanium oxide particle coated with tin oxide doped with phosphorus, tungsten, niobium, tantalum, or fluorine, the second metal oxide particle is an uncoated titanium oxide particle, a content of the first metal oxide particle in the conductive layer is not less than 20% by volume and not more than 50% by volume based on a total volume of the conductive layer, and a content of the second metal oxide particle in the conductive layer is not less than 1.0% by volume and not more than 15% by volume based on the total volume of the conductive layer, and not less than 5.0% by volume and not more than 30% by volume based on the content of the first metal oxide particle in the conductive layer.

According to another aspect of the present invention, there is provided a process cartridge that integrally supports the electrophotographic photosensitive member and at least one selected from the group consisting of a charging unit, a developing unit, a transfer unit, and a cleaning unit, and is detachably mountable on a main body of an electrophotographic apparatus.

According to further aspect of the present invention, there is provided an electrophotographic apparatus including the electrophotographic photosensitive member, a charging unit, an exposing unit, a developing unit, and a transfer unit.

Advantageous Effects of Invention

The present invention can provide an electrophotographic photosensitive member in which a leak hardly occurs even if the layer containing a titanium oxide particle coated with tin oxide doped with phosphorus, tungsten, niobium, tantalum, or fluorine as the metal oxide particle is used as the conductive layer in the electrophotographic photosensitive member, and provide the process cartridge and electrophotographic apparatus having the electrophotographic photosensitive member.

Further features of the present invention will become apparent from the following description of exemplary embodiments with reference to the attached drawings.

DESCRIPTION OF EMBODIMENTS

An electrophotographic photosensitive member according to the present invention is an electrophotographic photosensitive member including a support, a conductive layer formed on the support, and a photosensitive layer formed on the conductive layer.

The photosensitive layer may be a single photosensitive layer in which a charge-generating substance and a charge transport substance are contained in a single layer, or a laminated photosensitive layer in which a charge-generating layer containing a charge-generating substance and a charge transport layer containing a charge transport substance are laminated. Moreover, when necessary, the electrophotographic photosensitive member according to the present invention can be provided with an undercoat layer between the conductive layer formed on the support and the photosensitive layer.

As the support, those having conductivity (conductive support) can be used, and metallic supports formed with a metal such as aluminum, an aluminum alloy, and stainless steel can be used. In a case where aluminum or an aluminum alloy is used, an aluminum tube produced by a production method including extrusion and drawing or an aluminum tube produced by a production method including extrusion and ironing can be used. Such an aluminum tube has high precision of the size and surface smoothness without machining the surface, and has an advantage from the viewpoint of cost. Unfortunately, the aluminum tube not machined often has defects like ragged projections on the surface thereof. Then, the defects like ragged projections on the surface of the aluminum tube not machined are easily covered by providing the conductive layer.

In the present invention, the conductive layer is provided on the support to cover the defects on the surface of the support.

The conductive layer can have a volume resistivity of not less than $1.0\times10^{8}$ Ω·cm and not more than $5.0\times10^{12}$ Ω·cm. At a volume resistivity of the conductive layer of not more than $5.0\times10^{12}$ Ω·cm, a flow of charges hardly stagnates during image formation. As a result, the residual potential hardly increases, and the dark potential and the bright potential hardly fluctuate. At a volume resistivity of a conductive layer of not less than $1.0\times10^{8}$ Ω·cm, charges are difficult to excessively flow in the conductive layer during charging the electrophotographic photosensitive member, and the leak hardly occurs.

Figure 3:
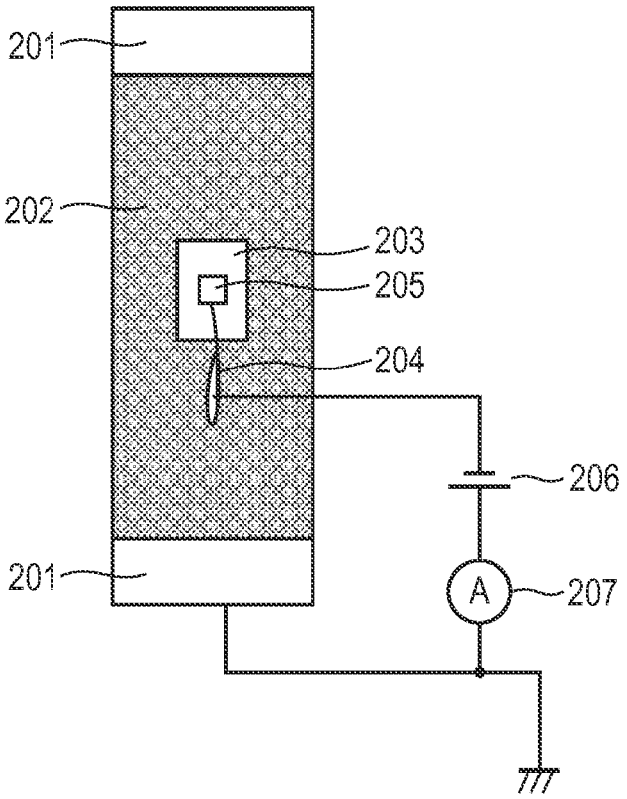
FIG. 3 is a drawing (top view) for describing a method for measuring a volume resistivity of a conductive layer.
Figure 4:
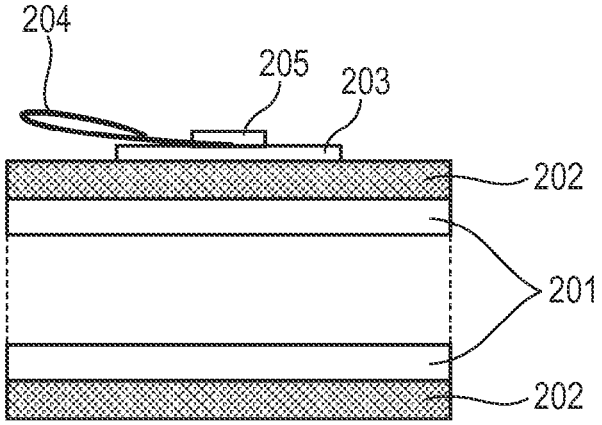
FIG. 4 is a drawing (sectional view) for describing a method for measuring a volume resistivity of a conductive layer.
Figure 5:
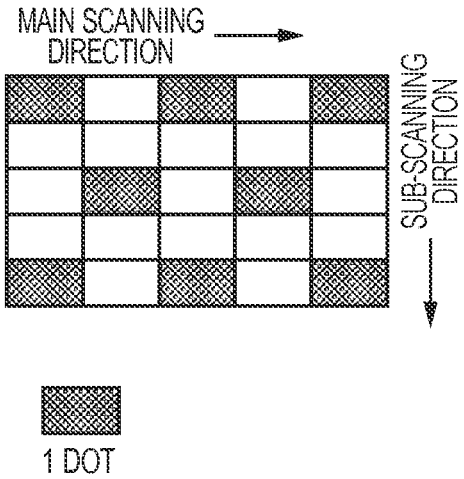
FIG. 5 is a drawing for describing an image of a one dot KEIMA pattern.

Using FIG. 3 and FIG. 4, a method for measuring the volume resistivity of the conductive layer in the electrophotographic photosensitive member will be described. FIG. 3 is a top view for describing a method for measuring a volume resistivity of a conductive layer, and FIG. 4 is a sectional view for describing a method for measuring a volume resistivity of a conductive layer.

The volume resistivity of the conductive layer is measured under an environment of normal temperature and normal humidity (23° C./50% RH). A copper tape 203 (made by Sumitomo 3M Limited, No. 1181) is applied to the surface of the conductive layer 202, and the copper tape is used as an electrode on the side of the surface of the conductive layer 202. The support 201 is used as an electrode on a rear surface side of the conductive layer 202. Between the copper tape 203 and the support 201, a power supply 206 for applying voltage, and a current measurement apparatus 207 for measuring the current that flows between the copper tape 203 and the support 201 are provided. In order to apply voltage to the copper tape 203, a copper wire 204 is placed on the copper tape 203, and a copper tape 205 similar to the copper tape 203 is applied onto the copper wire 204 such that the copper wire 204 is not out of the copper tape 203, to fix the copper wire 204 to the copper tape 203. The voltage is applied to the copper tape 203 using the copper wire 204.

The value represented by the following relation (1) is the volume resistivity ρ [Ω·cm] of the conductive layer 202 wherein $I_0$ [A] is a background current value when no voltage is applied between the copper tape 203 and the support 201, I [A] is a current value when −1 V of the voltage having only a DC voltage (DC component) is applied, the film thickness of the conductive layer 202 is d [cm], and the area of the electrode (copper tape 203) on the surface side of the conductive layer 202 is S [$cm^2$]:

$$\rho=1/(I-I_0)\times S/d\ [\Omega\cdot\mathrm{cm}] \quad (1)$$

In this measurement, a slight amount of the current of not more than $1\times10^{-6}$ A in an absolute value is measured. Accordingly, the measurement is preferably performed using a current measurement apparatus 207 that can measure such a slight amount of the current. Examples of such an apparatus include a pA meter (trade name: 4140B) made by Yokogawa Hewlett-Packard Ltd.

The volume resistivity of the conductive layer indicates the same value when the volume resistivity is measured in the state where only the conductive layer is formed on the support and in the state where the respective layers (such as the photosensitive layer) on the conductive layer are removed from the electrophotographic photosensitive member and only the conductive layer is left on the support.

The conductive layer in the electrophotographic photosensitive member of the present invention contains a binder material, a first metal oxide particle, and a second metal oxide particle.

In the present invention, as the first metal oxide particle, a titanium oxide ($TiO_2$) particle coated with tin oxide ($SnO_2$) doped with phosphorus (P), a titanium oxide ($TiO_2$) particle coated with tin oxide ($SnO_2$) doped with tungsten (W), a titanium oxide ($TiO_2$) particle coated with tin oxide ($SnO_2$) doped with niobium (Nb), a titanium oxide ($TiO_2$) particle coated with tin oxide ($SnO_2$) doped with tantalum (Ta), or a titanium oxide ($TiO_2$) particle coated with tin oxide ($SnO_2$)

doped with fluorine (F) is used. Hereinafter, these are also referred to as a "titanium oxide particle coated with P/W/Nb/Ta/F-doped tin oxide" generally.

Further, in the present invention, an uncoated titanium oxide particle is used as the second metal oxide particle. Here, the uncoated titanium oxide particle means a titanium oxide particle not coated with an inorganic material such as tin oxide and aluminum oxide and not coated (surface treated) with an organic material such as a silane coupling agent. This is also abbreviated to and referred to as an "uncoated titanium oxide particle".

The titanium oxide particle coated with P/W/Nb/Ta/F-doped tin oxide used as the first metal oxide particle is contained in the conductive layer. The content is not less than 20% by volume and not more than 50% by volume based on the total volume of the conductive layer.

The uncoated titanium oxide particle used as the second metal oxide particle is contained in the conductive layer. The content is not less than 1.0% by volume and not more than 15% by volume based on the total volume of the conductive layer, and not less than 5.0% by volume and not more than 30% by volume (preferably not less than 5.0% by volume and not more than 20% by volume) based on the content of the first metal oxide particle (titanium oxide particle coated with P/W/Nb/Ta/F-doped tin oxide) in the conductive layer.

If the content of the first metal oxide particle (titanium oxide particle coated with P/W/Nb/Ta/F-doped tin oxide) in the conductive layer is less than 20% by volume based on the total volume of the conductive layer, the distance between the first metal oxide particles (titanium oxide particles coated with P/W/Nb/Ta/F-doped tin oxide) are likely to be longer. As the distance between the first metal oxide particles (titanium oxide particles coated with P/W/Nb/Ta/F-doped tin oxide) are longer, the volume resistivity of the conductive layer is higher. Then, a flow of charges is likely to stagnate during image formation to increase the residual potential and fluctuate the dark potential and the bright potential.

If the content of the first metal oxide particle (titanium oxide particle coated with P/W/Nb/Ta/F-doped tin oxide) in the conductive layer is more than 50% by volume based on the total volume of the conductive layer, the first metal oxide particles (titanium oxide particles coated with P/W/Nb/Ta/F-doped tin oxide) are likely to contact each other. The portion of the conductive layer in which the first metal oxide particles (titanium oxide particles coated with P/W/Nb/Ta/F-doped tin oxide) contact each other has a low volume resistivity locally, and easily causes the leak to occur in the electrophotographic photosensitive member.

A method of producing a titanium oxide particle coated with tin oxide ($SnO_2$) doped with phosphorus (P) or the like is disclosed also in Japanese Patent Application Laid-Open No. H06-207118 and Japanese Patent Application Laid-Open No. 2004-349167.

It is thought that the uncoated titanium oxide particle as the second metal oxide particle plays a role for the titanium oxide particle coated with P/W/Nb/Ta/F-doped tin oxide as the first metal oxide particle in suppressing occurrence of the leak when a high voltage is applied to the electrophotographic photosensitive member under a low temperature and low humidity environment.

It is thought that charges flowing in the conductive layer usually flow mainly on the surface of the titanium oxide particle coated with P/W/Nb/Ta/F-doped tin oxide having a lower powder resistivity than that of the uncoated titanium oxide particle. However, when a high voltage is applied to the electrophotographic photosensitive member and excessive charges are going to flow in the conductive layer, the excessive charges cannot be completely flown only by the surface of the titanium oxide particle coated with P/W/Nb/Ta/F-doped tin oxide. As a result, the leak easily occurs in the electrophotographic photosensitive member.

Meanwhile, it is thought that by using the titanium oxide particle coated with P/W/Nb/Ta/F-doped tin oxide and the uncoated titanium oxide particle having a higher powder resistivity than that of the titanium oxide particle coated with P/W/Nb/Ta/F-doped tin oxide in combination for the conductive layer, charges flow on the surface of the uncoated titanium oxide particle in addition to the surface of the titanium oxide particle coated with P/W/Nb/Ta/F-doped tin oxide only when excessive charges are going to flow in the conductive layer. The titanium oxide particle coated with P/W/Nb/Ta/F-doped tin oxide and the uncoated titanium oxide particle both are metal oxide particles containing titanium oxide as a metal oxide. For this reason, it is thought that when excessive charges are going to flow in the conductive layer, the charges are easy to uniformly flow on the surface of the titanium oxide particle coated with P/W/Nb/Ta/F-doped tin oxide and the surface of the uncoated titanium oxide particle and uniformly flow in the conductive layer, and as a result occurrence of the leak is suppressed.

If the content of the second metal oxide particle (uncoated titanium oxide particle) in the conductive layer is less than 1.0% by volume based on the total volume of the conductive layer, the effect to be obtained by containing the second metal oxide particle (uncoated titanium oxide particle) in the conductive layer is small.

If the content of the second metal oxide particle (uncoated titanium oxide particle) in the conductive layer is more than 20% by volume based on the total volume of the conductive layer, the volume resistivity of the conductive layer is likely to be higher. Then, a flow of charges is likely to stagnate during image formation to increase the residual potential and fluctuate the dark potential and the bright potential.

If the content of the second metal oxide particle (uncoated titanium oxide particle) in the conductive layer is less than 5.0% by volume based on the content of the titanium oxide particle coated with P/W/Nb/Ta/F-doped tin oxide, the effect to be obtained by containing the second metal oxide particle (uncoated titanium oxide particle) in the conductive layer is small.

If the content of the second metal oxide particle (uncoated titanium oxide particle) in the conductive layer is more than 30% by volume based on the content of the titanium oxide particle coated with P/W/Nb/Ta/F-doped tin oxide, the volume resistivity of the conductive layer is likely to be higher. Then, a flow of charges is likely to stagnate during image formation to increase the residual potential and fluctuate the dark potential and the bright potential.

The form of the titanium oxide ($TiO_2$) particle as the core material particle in the titanium oxide particle coated with P/W/Nb/Ta/F-doped tin oxide and the form of the uncoated titanium oxide particle in use can be granular, spherical, needle-like, fibrous, cylindrical, rod-like, spindle-like, plate-like, and other forms. Among these, spherical forms are preferable because image defects such as black spots are decreased.

The titanium oxide ($TiO_2$) particle as the core material particle in the titanium oxide particle coated with P/W/Nb/Ta/F-doped tin oxide may have any crystal form of rutile, anatase, and brookite forms, for example. The titanium oxide ($TiO_2$) particle may be amorphous. The same is true of the uncoated titanium oxide particle.

The method of producing a particle may be any production method such as a sulfuric acid method and a hydrochloric acid method, for example.

The first metal oxide particle (titanium oxide particle coated with P/W/Nb/Ta/F-doped tin oxide) in the conductive layer has the average primary particle diameter ($D_1$) of preferably not less than 0.10 μm and not more than 0.45 μm, and more preferably not less than 0.15 μm and not more than 0.40 μm.

If the first metal oxide particle (titanium oxide particle coated with P/W/Nb/Ta/F-doped tin oxide) has the average primary particle diameter of not less than 0.10 μm, the first metal oxide particle (titanium oxide particle coated with P/W/Nb/Ta/F-doped tin oxide) hardly aggregates again after the coating liquid for a conductive layer is prepared. If the first metal oxide particle (titanium oxide particle coated with P/W/Nb/Ta/F-doped tin oxide) aggregates again, the stability of the coating liquid for a conductive layer easily reduces, or the surface of the conductive layer to be formed easily cracks.

If the first metal oxide particle (titanium oxide particle coated with P/W/Nb/Ta/F-doped tin oxide) has the average primary particle diameter of not more than 0.45 μm, the surface of the conductive layer hardly roughens. If the surface of the conductive layer roughens, charges are likely to be locally injected into the photosensitive layer, causing remarkable black dots (black spots) in the white solid portion in the output image.

The ratio ($D_1/D_2$) of the average primary particle diameter ($D_1$) of the first metal oxide particle (titanium oxide particle coated with P/W/Nb/Ta/F-doped tin oxide) to the average primary particle diameter ($D_2$) of the second metal oxide particle (uncoated titanium oxide particle) in the conductive layer can be not less than 0.7 and not more than 1.3.

At a ratio ($D_1/D_2$) of not less than 0.7, the average primary particle diameter of the second metal oxide particle (uncoated titanium oxide particle) is not excessively larger than the average primary particle diameter of the first metal oxide particle (titanium oxide particle coated with P/W/Nb/Ta/F-doped tin oxide). Thereby, the dark potential and the bright potential hardly fluctuate.

At a ratio ($D_1/D_2$) of not more than 1.3, the average primary particle diameter of the second metal oxide particle (uncoated titanium oxide particle) is not excessively smaller than the average primary particle diameter of the first metal oxide particle (titanium oxide particle coated with P/W/Nb/Ta/F-doped tin oxide). Thereby, the leak hardly occurs.

In the present invention, the content of the first metal oxide particle and second metal oxide particle in the conductive layer and the average primary particle diameter thereof are measured based on a three-dimensional structure analysis obtained from the element mapping using an FIB-SEM and FIB-SEM slice & view.

A method of measuring the powder resistivity of the titanium oxide particle coated with P/W/Nb/Ta/F-doped tin oxide is as follows.

The powder resistivity of the first metal oxide particle (titanium oxide particle coated with P/W/Nb/Ta/F-doped tin oxide) and that of the second metal oxide particle (uncoated titanium oxide particle) are measured under a normal temperature and normal humidity (23° C./50% RH) environment. In the present invention, a resistivity meter (trade name: Loresta GP) made by Mitsubishi Chemical Corporation was used as a measurement apparatus. The first metal oxide particle (titanium oxide particle coated with P/W/Nb/Ta/F-doped tin oxide) and second metal oxide particle (uncoated titanium oxide particle) to be measured both are solidified at a pressure of 500 kg/cm$^2$ and formed into a pellet-like measurement sample. The voltage to be applied is 100 V.

The conductive layer can be formed as follows: a coating liquid for a conductive layer containing a solvent, a binder material, the first metal oxide particle (titanium oxide particle coated with P/W/Nb/Ta/F-doped tin oxide), and the second metal oxide particle (uncoated titanium oxide particle) is applied onto the support, and the obtained coating film is dried and/or cured.

The coating liquid for a conductive layer can be prepared by dispersing the first metal oxide particle (titanium oxide particle coated with P/W/Nb/Ta/F-doped tin oxide) and the second metal oxide particle (uncoated titanium oxide particle) in a solvent together with the binder material. Examples of a dispersion method include methods using a paint shaker, a sand mill, a ball mill, and a liquid collision type high-speed dispersing machine.

Examples of a binder material used for preparation of the coating liquid for a conductive layer include resins such as phenol resins, polyurethanes, polyamides, polyimides, polyamidimides, polyvinyl acetals, epoxy resins, acrylic resins, melamine resins, and polyesters. One of these or two or more thereof can be used. Among these resins, curable resins are preferable and thermosetting resins are more preferable from the viewpoint of suppressing migration (transfer) to other layer, adhesive properties to the support, the dispersibility and dispersion stability of the first metal oxide particle (titanium oxide particle coated with P/W/Nb/Ta/F-doped tin oxide) and the second metal oxide particle (uncoated titanium oxide particle), and resistance against a solvent after formation of the layer. Among the thermosetting resins, thermosetting phenol resins and thermosetting polyurethanes are preferable. In a case where a curable resin is used for the binder material for the conductive layer, the binder material contained in the coating liquid for a conductive layer is a monomer and/or oligomer of the curable resin.

Examples of a solvent used for the coating liquid for a conductive layer include alcohols such as methanol, ethanol, and isopropanol; ketones such as acetone, methyl ethyl ketone, and cyclohexanone; ethers such as tetrahydrofuran, dioxane, ethylene glycol monomethyl ether, and propylene glycol monomethyl ether; esters such as methyl acetate and ethyl acetate; and aromatic hydrocarbons such as toluene and xylene.

From the viewpoint of covering the defects of the surface of the support, the film thickness of the conductive layer is preferably not less than 10 μm and not more than 40 μm, and more preferably not less than 15 μm and not more than 35 μm.

In the present invention, FISCHERSCOPE MMS made by Helmut Fischer GmbH was used as an apparatus for measuring the film thickness of each layer in the electrophotographic photosensitive member including a conductive layer.

In order to suppress interference fringes produced on the output image by interference of the light reflected on the surface of the conductive layer, the coating liquid for a conductive layer may contain a surface roughening material for roughening the surface of the conductive layer. As the surface roughening material, resin particles having the average particle diameter of not less than 1 μm and not more than 5 μm are preferable. Examples of the resin particles include particles of curable resins such as curable rubbers, polyurethanes, epoxy resins, alkyd resins, phenol resins, polyesters, silicone resins, and acrylic-melamine resins. Among these, particles of silicone resins difficult to aggregate are preferable. The specific gravity of the resin particle (0.5 to 2) is smaller than that of the titanium oxide particle coated with P/W/Nb/Ta/F-doped tin oxide (4 to 7). For this reason, the surface of the conductive layer is efficiently roughened at the time of forming the conductive layer. The content of the surface roughening material in the coating liquid for a conductive layer is preferably 1 to 80% by mass based on the binder material in the coating liquid for a conductive layer.

In the present invention, the densities [g/cm$^3$] of the first metal oxide particle, the second metal oxide particle, the binder material (the density of the cured product is measured when the binder material is liquid), the silicone particle, and the like were determined using a dry type automatic densimeter as follows.

A dry type automatic densimeter made by SHIMADZU Corporation (trade name: Accupyc 1330) was used. As a pre-treatment of the particle to be measured, a container having a volume of 10 cm$^3$ was purged with helium gas at a temperature of 23° C. and the highest pressure of 19.5 psig 10 times. Subsequently, the pressure, 0.0050 psig/min, was defined as the index of the pressure equilibrium determination value indicating whether the container inner pressure reached equilibrium. It was considered that the deflection of the pressure inside of the sample chamber of the value or less indicated the equilibrium state, and the measurement was started. Thus, the density [g/cm$^3$] was automatically measured.

The density of the first metal oxide particle can be adjusted according to the amount of tin oxide to be coated, the kind of elements used for doping, the amount of the element to be doped with, and the like.

The density of the second metal oxide particle (uncoated titanium oxide) can also be adjusted according to the crystal form and the mixing ratio.

The coating liquid for a conductive layer may also contain a leveling agent for increasing surface properties of the conductive layer.

In order to prevent charge injection from the conductive layer to the photosensitive layer, the electrophotographic photosensitive member according to the present invention can be provided with an undercoat layer (barrier layer) having electrical barrier properties between the conductive layer and the photosensitive layer.

The undercoat layer can be formed by applying a coating solution for an undercoat layer containing a resin (binder resin) onto the conductive layer, and drying the obtained coating film.

Examples of the resin (binder resin) used for the undercoat layer include water soluble resins such as polyvinyl alcohol, polyvinyl methyl ether, polyacrylic acids, methyl cellulose, ethyl cellulose, polyglutamic acid, casein, and starch, polyamides, polyimides, polyamidimides, polyamic acids, melamine resins, epoxy resins, polyurethanes, and polyglutamic acid esters. Among these, in order to produce electrical barrier properties of the undercoat layer effectively, thermoplastic resins are preferable. Among the thermoplastic resins, thermoplastic polyamides are preferable. As polyamides, copolymerized nylons are preferable.

The film thickness of the undercoat layer is preferably not less than 0.1 μm and not more than 2 μm.

In order to prevent a flow of charges from stagnating in the undercoat layer, the undercoat layer may contain an electron transport substance (electron-receptive substance such as an acceptor).

Examples of the electron transport substance include electron-withdrawing substances such as 2,4,7-trinitrofluorenone, 2,4,5,7-tetranitrofluorenone, chloranil, and tetracyanoquinodimethane, and polymerized products of these electron-withdrawing substances.

On the conductive layer (undercoat layer), the photosensitive layer is provided.

Examples of the charge-generating substance used for the photosensitive layer include azo pigments such as monoazos, disazos, and trisazos; phthalocyanine pigments such as metal phthalocyanine and non-metallic phthalocyanine; indigo pigments such as indigo and thioindigo; perylene pigments such as perylene acid anhydrides and perylene acid imides; polycyclic quinone pigments such as anthraquinone and pyrenequinone; squarylium dyes; pyrylium salts and thiapyrylium salts; triphenylmethane dyes; quinacridone pigments; azulenium salt pigments; cyanine dyes; xanthene dyes; quinoneimine dyes; and styryl dyes. Among these, metal phthalocyanines such as oxytitanium phthalocyanine, hydroxy gallium phthalocyanine, and chlorogallium phthalocyanine are preferable.

In a case where the photosensitive layer is a laminated photosensitive layer, a coating solution for a charge-generating layer prepared by dispersing a charge-generating substance and a binder resin in a solvent can be applied and the obtained coating film is dried to form a charge-generating layer. Examples of the dispersion method include methods using a homogenizer, an ultrasonic wave, a ball mill, a sand mill, an attritor, or a roll mill.

Examples of the binder resin used for the charge-generating layer include polycarbonates, polyesters, polyarylates, butyral resins, polystyrenes, polyvinyl acetals, diallyl phthalate resins, acrylic resins, methacrylic resins, vinyl acetate resins, phenol resins, silicone resins, polysulfones, styrene-butadiene copolymers, alkyd resins, epoxy resins, urea resins, and vinyl chloride-vinyl acetate copolymers. One of these can be used alone, or two or more thereof can be used as a mixture or a copolymer.

The proportion of the charge-generating substance to the binder resin (charge-generating substance:binder resin) is preferably in the range of 10:1 to 1:10 (mass ratio), and more preferably in the range of 5:1 to 1:1 (mass ratio).

Examples of the solvent used for the coating solution for a charge-generating layer include alcohols, sulfoxides, ketones, ethers, esters, aliphatic halogenated hydrocarbons, and aromatic compounds.

The film thickness of the charge-generating layer is preferably not more than 5 μm, and more preferably not less than 0.1 μm and not more than 2 μm.

To the charge-generating layer, a variety of additives such as a sensitizer, an antioxidant, an ultraviolet absorbing agent, and a plasticizer can be added when necessary. In order to prevent a flow of charges from stagnating in the charge-generating layer, the charge-generating layer may contain an electron transport substance (an electron-receptive substance such as an acceptor).

Examples of the electron transport substance include electron-withdrawing substances such as 2,4,7-trinitrofluorenone, 2,4,5,7-tetranitrofluorenone, chloranil, and tetracyanoquinodimethane, and polymerized products of these electron-withdrawing substances.

Examples of the charge transport substance used for the photosensitive layer include triarylamine compounds, hydrazone compounds, styryl compounds, stilbene compounds, pyrazoline compounds, oxazole compounds, thiazole compounds, and triallylmethane compounds.

In a case where the photosensitive layer is a laminated photosensitive layer, a coating solution for a charge transport layer prepared by dissolving the charge transport substance and a binder resin in a solvent can be applied and the obtained coating film is dried to form a charge transport layer.

Examples of the binder resin used for the charge transport layer include acrylic resins, styrene resins, polyesters, polycarbonates, polyarylates, polysulfones, polyphenylene oxides, epoxy resins, polyurethanes, alkyd resins, and unsaturated resins. One of these can be used alone, or two or more thereof can be used as a mixture or a copolymer.

The proportion of the charge transport substance to the binder resin (charge transport substance:binder resin) is preferably in the range of 2:1 to 1:2 (mass ratio).

Examples of the solvent used for the coating solution for a charge transport layer include ketones such as acetone and methyl ethyl ketone; esters such as methyl acetate and ethyl acetate; ethers such as dimethoxymethane and dimethoxyethane; aromatic hydrocarbons such as toluene and xylene; and hydrocarbons substituted by a halogen atom such as chlorobenzene, chloroform, and carbon tetrachloride.

From the viewpoint of charging uniformity and reproductivity of an image, the film thickness of the charge transport layer is preferably not less than 3 μm and not more than 40 μm, and more preferably not less than 4 μm and not more than 30 μm.

To the charge transport layer, an antioxidant, an ultraviolet absorbing agent, and a plasticizer can be added when necessary.

In a case where the photosensitive layer is a single photosensitive layer, a coating solution for a single photosensitive layer containing a charge-generating substance, a charge transport substance, a binder resin, and a solvent can be applied and the obtained coating film is dried to form a single photosensitive layer. As the charge-generating substance, the charge transport substance, the binder resin, and the solvent, a variety of the materials described above can be used, for example.

On the photosensitive layer, a protective layer may be provided to protect the photosensitive layer.

A coating solution for a protective layer containing a resin (binder resin) can be applied and the obtained coating film is dried and/or cured to form a protective layer.

The film thickness of the protective layer is preferably not less than 0.5 μm and not more than 10 μm, and more preferably not less than 1 μm and not more than 8 μm.

In application of the coating solutions for the respective layers above, application methods such as a dip coating method (an immersion coating method), a spray coating method, a spin coating method, a roll coating method, a Meyer bar coating method, and a blade coating method can be used.

Figure 1:
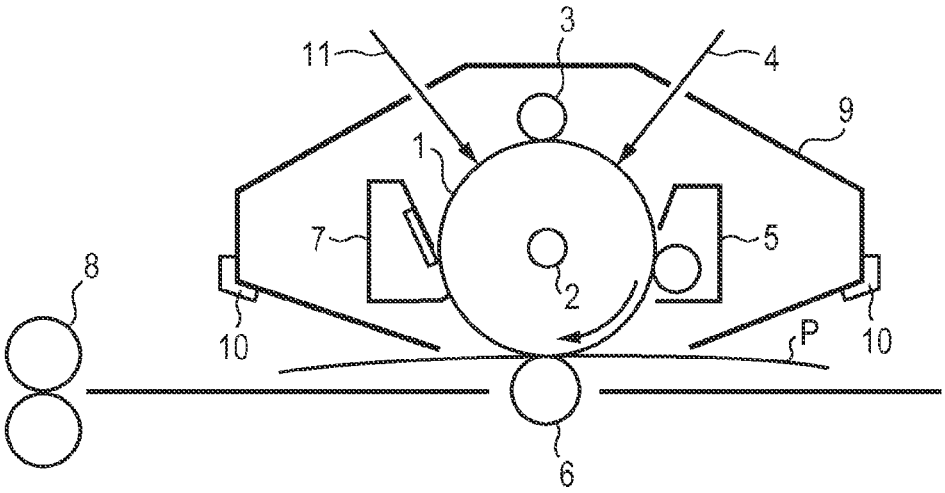
FIG. 1 is a drawing illustrating an example of a schematic configuration of an electrophotographic apparatus including a process cartridge having an electrophotographic photosensitive member.

FIG. 1 illustrates an example of a schematic configuration of an electrophotographic apparatus including a process cartridge having an electrophotographic photosensitive member.

In FIG. 1, a drum type (cylindrical) electrophotographic photosensitive member 1 is rotated and driven around a shaft 2 in the arrow direction at a predetermined circumferential speed.

The surface (circumferential surface) of the electrophotographic photosensitive member 1 rotated and driven is uniformly charged at a predetermined positive or negative potential by a charging unit (a primary charging unit, a charging roller, or the like) 3. Next, the circumferential surface of the electrophotographic photosensitive member 1 receives exposure light (image exposure light) 4 output from an exposing unit such as slit exposure or laser beam scanning exposure (not illustrated). Thus, an electrostatic latent image corresponding to a target image is sequentially formed on the circumferential surface of the electrophotographic photosensitive member 1. The voltage applied to the charging unit 3 may be only DC voltage, or DC voltage on which AC voltage is superimposed.

The electrostatic latent image formed on the circumferential surface of the electrophotographic photosensitive member 1 is developed by a toner of a developing unit 5 to form a toner image. Next, the toner image formed on the circumferential surface of the electrophotographic photosensitive member 1 is transferred onto a transfer material (such as paper) P by a transfer bias from a transferring unit (such as a transfer roller) 6. The transfer material P is fed from a transfer material feeding unit (not illustrated) between the electrophotographic photosensitive member 1 and the transferring unit 6 (contact region) in synchronization with rotation of the electrophotographic photosensitive member 1.

The transfer material P having the toner image transferred is separated from the circumferential surface of the electrophotographic photosensitive member 1, and introduced to a fixing unit 8 to fix the image. Thereby, an image forming product (print, copy) is printed out of the apparatus.

From the circumferential surface of the electrophotographic photosensitive member 1 after transfer of the toner image, the remaining toner of transfer is removed by a cleaning unit (such as a cleaning blade) 7. Further, the circumferential surface of the electrophotographic photosensitive member 1 is discharged by pre-exposure light 11 from a pre-exposing unit (not illustrated), and is repeatedly used for image formation. In a case where the charging unit is a contact charging unit such as a charging roller, the pre-exposure is not always necessary.

The electrophotographic photosensitive member 1 and at least one component selected from the charging unit 3, the developing unit 5, the transferring unit 6, and the cleaning unit 7 may be accommodated in a container and integrally supported as a process cartridge, and the process cartridge may be detachably attached to the main body of the electrophotographic apparatus. In FIG. 1, the electrophotographic photosensitive member 1, the charging unit 3, the developing unit 5, and the cleaning unit 7 are integrally supported to form a process cartridge 9, which is detachably attached to the main body of the electrophotographic apparatus using a guide unit 10 such as a rail in the main body of the electrophotographic apparatus. The electrophotographic apparatus may include the electrophotographic photosensitive member 1, the charging unit 3, the exposing unit, the developing unit 5, and the transferring unit 6.

EXAMPLE

Hereinafter, using specific Examples, the present invention will be described more in detail. However, the present invention will not be limited to these. In Examples and Comparative Examples, "parts" mean "parts by mass". In each of the particles in Examples and Comparative Examples, the particle diameter distribution had one peak.

<Preparation Example of Coating Liquid for a Conductive Layer>

(Preparation Example of Coating Liquid for a Conductive Layer 1)

120 Parts of the titanium oxide ($TiO_2$) particle coated with tin oxide ($SnO_2$) doped with phosphorus (P) as the first metal oxide particle (powder resistivity: $5.0\times10^2$ Ω·cm, average primary particle diameter: 0.20 μm, powder resistivity of the core material particle (rutile titanium oxide ($TiO_2$) particle): $5.0\times10^7$ Ω·cm, average primary particle diameter of the core material particle (titanium oxide ($TiO_2$) particle): 0.18 μm, density: 5.1 g/cm$^2$), 7 parts of the uncoated titanium oxide ($TiO_2$) particle as the second metal oxide particle (rutile titanium oxide, powder resistivity: $5.0\times10^7$ Ω·cm, average primary particle diameter: 0.20 μm, density: 4.2 g/cm$^2$), 168 parts of a phenol resin as the binder material (monomer/oligomer of the phenol resin) (trade name: Plyophen J-325, made by DIC Corporation, resin solid content: 60%, density after curing: 1.3 g/cm$^2$), and 98 parts of 1-methoxy-2-propanol as a solvent were placed in a sand mill using 420 parts of glass beads having a diameter of 0.8 mm, and subjected to a dispersion treatment under the conditions of the number of rotation: 1500 rpm and the dispersion treatment time: 4 hours to obtain a dispersion liquid.

The glass beads were removed from the dispersion liquid with a mesh.

13.8 parts of a silicone resin particle as a surface roughening material (trade name: Tospearl 120, made by Momentive Performance Materials Inc., average particle diameter: 2 μm, density: 1.3 g/cm$^2$), 0.014 parts of a silicone oil as a leveling agent (trade name: SH28PA, made by Dow Corning Toray Co., Ltd.), 6 parts of methanol, and 6 parts of 1-methoxy-2-propanol were added to the dispersion liquid from which the glass beads were removed, and stirred to prepare a coating liquid for a conductive layer 1.

(Preparation Examples of Coating Liquids for Conductive Layer 2 to 78, C1 to C47, and C54 to C71)

Coating liquids for a conductive layer 2 to 78, C1 to C47, and C54 to C71 were prepared by the same operation as that in Preparation Example of the coating liquid for a conductive layer 1 except that the kinds, average primary particle diameters, and amounts (parts) of the first metal oxide particle and the second metal oxide particle used in preparation of the coating liquid for a conductive layer were changed as shown in Tables 1 to 7. Further, in preparation of the coating liquids for a conductive layer 18, 60, and 78, the conditions of the dispersion treatment were changed to the number of rotation: 2500 rpm and dispersion treatment time: 30 hours.

TABLE 1

| | First metal oxide particle | | | | Second metal oxide particle (Uncoated titanium oxide particle) | | Binder material (B) (phenol resin) Amount [parts] (resin solid |
|---|---|---|---|---|---|---|---|
| Coating solution for conductive layer | Kind | Powder resistivity [Ω · cm] | Average primary particle diameter [μm] | Amount [parts] | Average primary particle diameter [μm] | Amount [parts] | content is 60% by mass of amount below) |
| 1 | Titanium | $5.0 \times 10^2$ | 0.20 | 120 | 0.20 | 5 | 168 |
| 2 | oxide | $5.0 \times 10^2$ | 0.20 | 120 | 0.20 | 20 | 168 |
| 3 | particle | $5.0 \times 10^2$ | 0.20 | 120 | 0.20 | 30 | 168 |
| 4 | coated with | $5.0 \times 10^2$ | 0.20 | 250 | 0.20 | 11 | 168 |
| 5 | tinox ide | $5.0 \times 10^2$ | 0.20 | 250 | 0.20 | 18 | 168 |
| 6 | doped with | $5.0 \times 10^2$ | 0.20 | 450 | 0.20 | 37 | 168 |
| 7 | phosphorus | $5.0 \times 10^2$ | 0.20 | 460 | 0.20 | 19 | 168 |
| 8 | Density: | $5.0 \times 10^2$ | 0.20 | 250 | 0.20 | 29 | 168 |
| 9 | 5.1 g/cm$^2$ | $5.0 \times 10^2$ | 0.20 | 250 | 0.20 | 53 | 168 |
| 10 | | $5.0 \times 10^2$ | 0.20 | 500 | 0.20 | 85 | 168 |
| 11 | | $5.0 \times 10^2$ | 0.20 | 550 | 0.20 | 135 | 168 |
| 12 | | $5.0 \times 10^2$ | 0.45 | 250 | 0.20 | 11 | 168 |
| 13 | | $5.0 \times 10^2$ | 0.45 | 250 | 0.40 | 11 | 168 |
| 14 | | $5.0 \times 10^2$ | 0.15 | 250 | 0.15 | 11 | 168 |
| 15 | | $5.0 \times 10^2$ | 0.15 | 250 | 0.10 | 11 | 168 |
| 16 | | $2.0 \times 10^2$ | 0.20 | 250 | 0.20 | 18 | 168 |
| 17 | | $1.5 \times 10^3$ | 0.20 | 250 | 0.20 | 18 | 168 |
| 18 | | $5.0 \times 10^2$ | 0.20 | 130 | 0.20 | 6 | 168 |

TABLE 2

| | First metal oxide particle | | | | Second metal oxide particle (Uncoated titanium oxide particle) | | Binder material (B) (phenol resin) Amount [parts] (resin solid |
|---|---|---|---|---|---|---|---|
| Coating solution for conductive layer | Kind | Powder resistivity [Ω · cm] | Average primary particle diameter [μm] | Amount [parts] | Average primary particle diameter [μm] | Amount [parts] | content is 60% by mass of amount below) |
| 19 | Titanium | $5.0 \times 10^2$ | 0.20 | 115 | 0.20 | 7 | 168 |
| 20 | oxide | $5.0 \times 10^2$ | 0.20 | 250 | 0.20 | 10 | 168 |
| 21 | particle | $5.0 \times 10^2$ | 0.20 | 250 | 0.20 | 17 | 168 |

TABLE 2-continued

| Coating solution for conductive layer | First metal oxide particle Kind | Powder resistivity [Ω · cm] | Average primary particle diameter [μm] | Amount [parts] | Second metal oxide particle (Uncoated titanium oxide particle) Average primary particle diameter [μm] | Amount [parts] | Binder material (B) (phenol resin) Amount [parts] (resin solid content is 60% by mass of amount below) |
|---|---|---|---|---|---|---|---|
| 22 | coated | $5.0 \times 10^2$ | 0.20 | 500 | 0.20 | 40 | 168 |
| 23 | with tin | $5.0 \times 10^2$ | 0.20 | 250 | 0.20 | 30 | 168 |
| 24 | oxide | $5.0 \times 10^2$ | 0.20 | 250 | 0.20 | 50 | 168 |
| 25 | doped with | $5.0 \times 10^2$ | 0.20 | 500 | 0.20 | 80 | 168 |
| 26 | tungsten | $5.0 \times 10^2$ | 0.20 | 500 | 0.20 | 120 | 168 |
| 27 | Density: | $5.0 \times 10^2$ | 0.45 | 255 | 0.20 | 18 | 168 |
| 28 | 5.2 g/cm$^2$ | $5.0 \times 10^2$ | 0.45 | 255 | 0.40 | 18 | 168 |
| 29 | | $5.0 \times 10^2$ | 0.15 | 255 | 0.15 | 18 | 168 |
| 30 | | $5.0 \times 10^2$ | 0.15 | 255 | 0.10 | 18 | 168 |
| 31 | Titanium | $5.0 \times 10^2$ | 0.20 | 110 | 0.20 | 7 | 168 |
| 32 | oxide | $5.0 \times 10^2$ | 0.20 | 240 | 0.20 | 10 | 168 |
| 33 | particle | $5.0 \times 10^2$ | 0.20 | 240 | 0.20 | 17 | 168 |
| 34 | coated | $5.0 \times 10^2$ | 0.20 | 500 | 0.20 | 42 | 168 |
| 35 | with tin | $5.0 \times 10^2$ | 0.20 | 240 | 0.20 | 29 | 168 |
| 36 | oxide | $5.0 \times 10^2$ | 0.20 | 240 | 0.20 | 52 | 168 |
| 37 | doped | $5.0 \times 10^2$ | 0.20 | 500 | 0.20 | 85 | 168 |
| 38 | with | $5.0 \times 10^2$ | 0.20 | 500 | 0.20 | 125 | 168 |
| 39 | fluorine | $5.0 \times 10^2$ | 0.45 | 240 | 0.20 | 18 | 168 |
| 40 | Density: | $5.0 \times 10^2$ | 0.45 | 240 | 0.40 | 18 | 168 |
| 41 | 5.0 g/cm$^2$ | $5.0 \times 10^2$ | 0.15 | 240 | 0.15 | 18 | 168 |
| 42 | | $5.0 \times 10^2$ | 0.15 | 240 | 0.10 | 18 | 168 |

TABLE 3

| Coating solution for conductive layer | First metal oxide particle Kind | Powder resistivity [Ω · cm] | Average primary particle diameter [μm] | Amount [parts] | Second metal oxide particle (Uncoated titanium oxide particle) Average primary particle diameter [μm] | Amount [parts] | Binder material (B) (phenol resin) Amount [parts] (resin solid content is 60% by mass of amount below) |
|---|---|---|---|---|---|---|---|
| 43 | Titanium | $5.0 \times 10^2$ | 0.20 | 120 | 0.20 | 5 | 168 |
| 44 | oxide | $5.0 \times 10^2$ | 0.20 | 120 | 0.20 | 20 | 168 |
| 45 | particle | $5.0 \times 10^2$ | 0.20 | 120 | 0.20 | 30 | 168 |
| 46 | coated | $5.0 \times 10^2$ | 0.20 | 250 | 0.20 | 11 | 168 |
| 47 | with tin | $5.0 \times 10^2$ | 0.20 | 250 | 0.20 | 18 | 168 |
| 48 | oxide | $5.0 \times 10^2$ | 0.20 | 450 | 0.20 | 37 | 168 |
| 49 | doped | $5.0 \times 10^2$ | 0.20 | 460 | 0.20 | 19 | 168 |
| 50 | with | $5.0 \times 10^2$ | 0.20 | 250 | 0.20 | 29 | 168 |
| 51 | niobium | $5.0 \times 10^2$ | 0.20 | 250 | 0.20 | 53 | 168 |
| 52 | Density: | $5.0 \times 10^2$ | 0.20 | 500 | 0.20 | 85 | 168 |
| 53 | 5.1 g/cm$^2$ | $5.0 \times 10^2$ | 0.20 | 500 | 0.20 | 120 | 168 |
| 54 | | $5.0 \times 10^2$ | 0.45 | 250 | 0.20 | 11 | 168 |
| 55 | | $5.0 \times 10^2$ | 0.45 | 250 | 0.40 | 11 | 168 |
| 56 | | $5.0 \times 10^2$ | 0.15 | 250 | 0.15 | 11 | 168 |
| 57 | | $5.0 \times 10^2$ | 0.15 | 250 | 0.10 | 11 | 168 |
| 58 | | $2.0 \times 10^2$ | 0.20 | 250 | 0.20 | 18 | 168 |
| 59 | | $1.5 \times 10^2$ | 0.20 | 250 | 0.20 | 18 | 168 |
| 60 | | $5.0 \times 10^2$ | 0.20 | 130 | 0.20 | 6 | 168 |

TABLE 4

| Coating solution for conductive layer | First metal oxide particle | | | | Second metal oxide particle (Uncoated titanium oxide particle) | | Binder material (B) (phenol resin) Amount [parts] (resin solid content is 60% by mass of amount below) |
|---|---|---|---|---|---|---|---|
| | Kind | Powder resistivity [Ω · cm] | Average primary particle diameter [μm] | Amount [parts] | Average primary particle diameter [μm] | Amount [parts] | |
| 61 | Titanium | $5.0 \times 10^2$ | 0.20 | 120 | 0.20 | 5 | 168 |
| 62 | oxide | $5.0 \times 10^2$ | 0.20 | 120 | 0.20 | 20 | 168 |
| 63 | particle | $5.0 \times 10^2$ | 0.20 | 120 | 0.20 | 30 | 168 |
| 64 | coated | $5.0 \times 10^2$ | 0.20 | 250 | 0.20 | 11 | 168 |
| 65 | with tin | $5.0 \times 10^2$ | 0.20 | 250 | 0.20 | 18 | 168 |
| 66 | oxide | $5.0 \times 10^2$ | 0.20 | 450 | 0.20 | 37 | 168 |
| 67 | doped | $5.0 \times 10^2$ | 0.20 | 460 | 0.20 | 19 | 168 |
| 68 | with | $5.0 \times 10^2$ | 0.20 | 250 | 0.20 | 29 | 168 |
| 69 | tantalum | $5.0 \times 10^2$ | 0.20 | 250 | 0.20 | 53 | 168 |
| 70 | Density: | $5.0 \times 10^2$ | 0.20 | 500 | 0.20 | 85 | 168 |
| 71 | 5.2 g/cm$^2$ | $5.0 \times 10^2$ | 0.20 | 500 | 0.20 | 120 | 168 |
| 72 | | $5.0 \times 10^2$ | 0.45 | 250 | 0.20 | 11 | 168 |
| 73 | | $5.0 \times 10^2$ | 0.45 | 250 | 0.40 | 11 | 168 |
| 74 | | $5.0 \times 10^2$ | 0.15 | 250 | 0.15 | 11 | 168 |
| 75 | | $5.0 \times 10^2$ | 0.15 | 250 | 0.10 | 11 | 168 |
| 76 | | $2.0 \times 10^2$ | 0.20 | 250 | 0.20 | 18 | 168 |
| 77 | | $1.5 \times 10^2$ | 0.20 | 250 | 0.20 | 18 | 168 |
| 78 | | $5.0 \times 10^2$ | 0.20 | 130 | 0.20 | 6 | 168 |

TABLE 5

| Coating solution for conductive layer | First metal oxide particle | | | | Second metal oxide particle (Uncoated titanium oxide particle) | | Binder material (B) (phenol resin) Amount [parts] (resin solid 60% by mass of amount below) |
|---|---|---|---|---|---|---|---|
| | Kind | Powder resistivity [Ω · cm] | Average primary particle diameter [μm] | Amount [parts] | Average primary particle diameter [μm] | Amount [parts] | |
| C1 | Titanium | $5.0 \times 10^2$ | 0.20 | 79 | 0.20 | 7 | 168 |
| C2 | oxide | $5.0 \times 10^2$ | 0.20 | 600 | 0.20 | 45 | 168 |
| C3 | particle | $5.0 \times 10^2$ | 0.20 | 240 | Not used | | 168 |
| C4 | coated with | $5.0 \times 10^2$ | 0.20 | 240 | 0.20 | 3 | 168 |
| C5 | tin oxide | $5.0 \times 10^2$ | 0.20 | 450 | 0.20 | 4 | 168 |
| C6 | doped with | $5.0 \times 10^2$ | 0.20 | 300 | 0.20 | 154 | 168 |
| C7 | phosphorus | $5.0 \times 10^2$ | 0.20 | 450 | 0.20 | 185 | 168 |
| C8 | Density: | $5.0 \times 10^2$ | 0.20 | 242 | 0.20 | 9 | 168 |
| C9 | 5.1 g/cm$^2$ | $5.0 \times 10^2$ | 0.20 | 242 | 0.20 | 68 | 168 |
| C10 | Titanium | $5.0 \times 10^2$ | 0.20 | 80 | 0.20 | 6 | 168 |
| C11 | oxide | $5.0 \times 10^2$ | 0.20 | 600 | 0.20 | 45 | 168 |
| C12 | particle | $5.0 \times 10^2$ | 0.20 | 250 | Not used | | 168 |
| C13 | coated with | $5.0 \times 10^2$ | 0.20 | 250 | 0.20 | 3 | 168 |
| C14 | tin oxide | $5.0 \times 10^2$ | 0.20 | 460 | 0.20 | 4 | 168 |
| C15 | doped with | $5.0 \times 10^2$ | 0.20 | 300 | 0.20 | 180 | 168 |
| C16 | tungsten | $5.0 \times 10^2$ | 0.20 | 460 | 0.20 | 189 | 168 |
| C17 | Density: | $5.0 \times 10^2$ | 0.20 | 247 | 0.20 | 6 | 168 |
| C18 | 5.2 g/cm$^2$ | $5.0 \times 10^2$ | 0.20 | 247 | 0.20 | 68 | 168 |
| C19 | Titanium | $5.0 \times 10^2$ | 0.20 | 78 | 0.20 | 7 | 168 |
| C20 | oxide | $5.0 \times 10^2$ | 0.20 | 600 | 0.20 | 46 | 168 |
| C21 | particle | $5.0 \times 10^2$ | 0.20 | 240 | Not used | | 168 |
| C22 | coated with | $5.0 \times 10^2$ | 0.20 | 240 | 0.20 | 3 | 168 |
| C23 | tin oxide doped | $5.0 \times 10^2$ | 0.20 | 441 | 0.20 | 4 | 168 |
| C24 | with | $5.0 \times 10^2$ | 0.20 | 300 | 0.20 | 180 | 168 |
| C25 | fluorine | $5.0 \times 10^2$ | 0.20 | 450 | 0.20 | 189 | 168 |

TABLE 5-continued

| Coating solution for conductive layer | First metal oxide particle Kind | Powder resistivity [Ω · cm] | Average primary particle diameter [μm] | Amount [parts] | Second metal oxide particle (Uncoated titanium oxide particle) Average primary particle diameter [μm] | Amount [parts] | Binder material (B) (phenol resin) Amount [parts] (resin solid 60% by mass of amount below) |
|---|---|---|---|---|---|---|---|
| C26 | Density: | $5.0 \times 10^2$ | 0.20 | 237 | 0.20 | 6 | 168 |
| C27 | 5.0 g/cm$^2$ | $5.0 \times 10^2$ | 0.20 | 237 | 0.20 | 68 | 168 |

TABLE 6

| Coating solution for conductive layer | First metal oxide particle Kind | Powder resistivity [Ω · cm] | Average primary particle diameter [μm] | Amount [parts] | Second metal oxide particle (Uncoated titanium oxide particle) Average primary particle diameter [μm] | Amount [parts] | Binder material (B) (phenol resin) Amount [parts] (resin solid content is 60% by mass of amount below) |
|---|---|---|---|---|---|---|---|
| C28 | Titanium oxide | $5.0 \times 10^2$ | 0.20 | 112 | 0.35 | 7 | 168 |
| C29 | particle | $5.0 \times 10^2$ | 0.20 | 242 | 0.20 | 10 | 168 |
| C30 | coated | $5.0 \times 10^2$ | 0.20 | 242 | 0.20 | 17 | 168 |
| C31 | with tin | $5.0 \times 10^2$ | 0.20 | 450 | 0.20 | 37 | 168 |
| C32 | oxide | $5.0 \times 10^2$ | 0.20 | 260 | 0.20 | 31 | 168 |
| C33 | doped | $5.0 \times 10^2$ | 0.20 | 260 | 0.20 | 55 | 168 |
| C34 | with | $5.0 \times 10^2$ | 0.20 | 500 | 0.20 | 85 | 168 |
| C35 | antimony | $5.0 \times 10^2$ | 0.20 | 500 | 0.20 | 120 | 168 |
| C36 | Density: | $5.0 \times 10^2$ | 0.45 | 255 | 0.40 | 18 | 168 |
| C37 | 5.1 g/cm$^2$ | $5.0 \times 10^2$ | 0.15 | 255 | 0.15 | 18 | 168 |
| C38 | Titanium | $5.0 \times 10^2$ | 0.20 | 112 | 0.35 | 7 | 168 |
| C39 | oxide | $5.0 \times 10^2$ | 0.20 | 242 | 0.20 | 10 | 168 |
| C40 | particle | $5.0 \times 10^2$ | 0.20 | 242 | 0.20 | 17 | 168 |
| C41 | coated | $5.0 \times 10^2$ | 0.20 | 450 | 0.20 | 37 | 168 |
| C42 | with | $5.0 \times 10^2$ | 0.20 | 260 | 0.20 | 31 | 168 |
| C43 | oxygen- | $5.0 \times 10^2$ | 0.20 | 260 | 0.20 | 55 | 168 |
| C44 | defective | $5.0 \times 10^2$ | 0.20 | 500 | 0.20 | 85 | 168 |
| C45 | tin | $5.0 \times 10^2$ | 0.20 | 500 | 0.20 | 120 | 168 |
| C46 | oxide | $5.0 \times 10^2$ | 0.45 | 255 | 0.40 | 18 | 168 |
| C47 | Density: 5.1 g/cm$^2$ | $5.0 \times 10^2$ | 0.15 | 255 | 0.15 | 18 | 168 |

TABLE 7

| Coating solution for conductive layer | First metal oxide particle Kind | Powder resistivity [Ω · cm] | Average primary particle diameter [μm] | Amount [parts] | Second metal oxide particle (Uncoated titanium oxide particle) Average primary particle diameter [μm] | Amount [parts] | Binder material (B) (phenol resin) Amount [parts] (resin solid content is 60% by mass of amount below) |
|---|---|---|---|---|---|---|---|
| C54 | Titanium | $5.0 \times 10^2$ | 0.20 | 79 | 0.20 | 7 | 168 |
| C55 | oxide | $5.0 \times 10^2$ | 0.20 | 600 | 0.20 | 45 | 168 |
| C56 | particle | $5.0 \times 10^2$ | 0.20 | 240 | Not used | | 168 |
| C57 | coated with | $5.0 \times 10^2$ | 0.20 | 240 | 0.20 | 3 | 168 |
| C58 | tin oxide | $5.0 \times 10^2$ | 0.20 | 450 | 0.20 | 4 | 168 |
| C59 | doped with | $5.0 \times 10^2$ | 0.20 | 300 | 0.20 | 154 | 168 |
| C60 | niobium | $5.0 \times 10^2$ | 0.20 | 450 | 0.20 | 185 | 168 |
| C61 | Density: | $5.0 \times 10^2$ | 0.20 | 242 | 0.20 | 9 | 168 |
| C62 | 5.1 g/cm$^2$ | $5.0 \times 10^2$ | 0.20 | 242 | | 68 | 168 |
| C63 | Titanium | $5.0 \times 10^2$ | 0.20 | 80 | 0.20 | 6 | 168 |
| C64 | oxide | $5.0 \times 10^2$ | 0.20 | 600 | 0.20 | 45 | 168 |
| C65 | particle | $5.0 \times 10^2$ | 0.20 | 250 | Not used | | 168 |
| C66 | coated with | $5.0 \times 10^2$ | 0.20 | 250 | 0.20 | 3 | 168 |
| C67 | tin oxide | $5.0 \times 10^2$ | 0.20 | 460 | 0.20 | 4 | 168 |
| C68 | doped with | $5.0 \times 10^2$ | 0.20 | 300 | 0.20 | 180 | 168 |
| C69 | tantalum | $5.0 \times 10^2$ | 0.20 | 460 | 0.20 | 189 | 168 |
| C70 | Density: | $5.0 \times 10^2$ | 0.20 | 247 | 0.20 | 6 | 168 |
| C71 | 5.2 g/cm$^2$ | $5.0 \times 10^2$ | 0.20 | 247 | 0.20 | 68 | 168 |

The "titanium oxide particle coated with tin oxide doped with antimony" and "titanium oxide particle coated with oxygen-defective tin oxide" in the coating liquids for a conductive layer C28 to C47 are not the first metal oxide particle according to the present invention. For comparison with the present invention, however, these particles are used as the first metal oxide particle for convenience. The same is true below.

(Preparation Example of Coating Liquid for Conductive Layer C48)

A coating liquid for a conductive layer was prepared by the same operation as the operation to prepare a coating liquid for a conductive layer L-4 which is described in Patent Literature 1. This coating liquid was used as a coating liquid for a conductive layer C48.

Namely, 54.8 parts of a titanium oxide ($TiO_2$) particle coated with tin oxide ($SnO_2$) doped with phosphorus (P) (average primary particle diameter: 0.15 μm, powder resistivity: $2.0\times10^2$ Ω·cm, coating percentage with tin oxide ($SnO_2$): 15% by mass, amount of phosphorus (P) used to dope tin oxide ($SnO_2$) (amount of dope):7% by mass), 36.5 parts of a phenol resin as a binding resin (trade name: Plyophen J-325, made by DIC Corporation, resin solid content: 60% by mass), and 50 parts of methoxypropanol as a solvent (1-methoxy-2-propanol) were placed in a sand mill using glass beads having a diameter of 0.5 mm, and subjected to a dispersion treatment under the dispersion treatment conditions of the number of rotation of the disk: 2500 rpm and the dispersion treatment time: 3.5 hours to obtain a dispersion liquid.

Parts of a silicone resin particle as a surface roughening material (trade name: Tospearl 120, made by Momentive Performance Materials Japan LLC, average particle diameter: 2 μm), and 0.001 parts of a silicone oil as a leveling agent (trade name: SH28PA, made by Dow Corning Toray Co., Ltd.) were added to this dispersion liquid, and stirred to prepare the coating liquid for a conductive layer C48.

(Preparation Example of Coating Liquid for Conductive Layer C49)

A coating liquid for a conductive layer was prepared by the same operation as the operation to prepare the coating liquid for a conductive layer L-14 which is described in Patent Literature 1. This coating liquid was used as a coating liquid for a conductive layer C49.

Namely, 37.5 parts of a titanium oxide ($TiO_2$) particle coated with tin oxide ($SnO_2$) doped with tungsten (W) (average primary particle diameter: 0.15 μm, powder resistivity: $2.5\times10^2$ Ω·cm, coating percentage with tin oxide ($SnO_2$): 15% by mass, amount of tungsten (W) used to dope tin oxide ($SnO_2$) (amount of dope): 7% by mass), 36.5 parts of a phenol resin as a binding resin (trade name: Plyophen J-325, made by DIC Corporation, resin solid content: 60% by mass), and 50 parts of methoxypropanol as a solvent (1-methoxy-2-propanol) were placed in a sand mill using glass beads having a diameter of 0.5 mm, and subjected to a dispersion treatment under the dispersion treatment conditions of the number of rotation of the disk: 2500 rpm and dispersion treatment time: 3.5 hours to obtain a dispersion liquid.

3.9 Parts of a silicone resin particle as a surface roughening material (trade name: Tospearl 120, made by Momentive Performance Materials Japan LLC, average particle diameter: 2 μm), and 0.001 parts of a silicone oil as a leveling agent (trade name: SH28PA, made by Dow Corning Toray Co., Ltd.) were added to the dispersion liquid, and stirred to prepare the coating liquid for a conductive layer C49.

(Preparation Example of Coating Liquid for Conductive Layer C50)

A coating liquid for a conductive layer was prepared by the same operation as the operation to prepare the coating liquid for a conductive layer L-30 which is described in Patent Literature 1. This coating liquid was used as a coating liquid for a conductive layer C50.

Namely, 60 parts of a titanium oxide ($TiO_2$) particle coated with tin oxide ($SnO_2$) doped with fluorine (F) (average primary particle diameter: 0.075 μm, powder resistivity: $3.0\times10^2$ Ω·cm, coating percentage with tin oxide ($SnO_2$): 15% by mass, amount of fluorine (F) used to dope tin oxide ($SnO_2$) (amount of dope): 7% by mass), 36.5 parts of a phenol resin as a biding resin (trade name: Plyophen J-325, made by DIC Corporation, resin solid content: 60% by mass), and 50 parts of methoxypropanol as a solvent (1-methoxy-2-propanol) were placed in a sand mill using glass beads having a diameter of 0.5 mm, and subjected to a dispersion treatment under the dispersion treatment conditions of the number of rotation of the disk: 2500 rpm and the dispersion treatment time: 3.5 hours to obtain a dispersion liquid.

3.9 Parts of a silicone resin particle as a surface roughening material (trade name: Tospearl 120, made by Momentive Performance Materials Japan LLC, average particle diameter: 2 μm), and 0.001 parts of a silicone oil as a leveling agent (trade name: SH28PA, made by Dow Corning Toray Co., Ltd.) were added to the dispersion liquid, and stirred to prepare a coating liquid for a conductive layer C50.

(Preparation Example of Coating Liquid for a Conductive Layer C51)

A coating liquid for a conductive layer was prepared by the same operation as the operation to prepare the coating liquid for a conductive layer 1 which is described in Patent Literature 2. This coating liquid was used as a coating liquid for a conductive layer C51.

Namely, 204 parts of a titanium oxide ($TiO_2$) particle coated with tin oxide ($SnO_2$) doped with phosphorus (P) (powder resistivity: $4.0\times10^1$ Ω·cm, coating percentage with tin oxide ($SnO_2$): 35% by mass, amount of phosphorus (P) used to dope tin oxide ($SnO_2$) (amount of dope): 3% by mass), 148 parts of a phenol resin as a biding resin (monomer/oligomer of the phenol resin) (trade name: Plyophen J-325, made by DIC Corporation, resin solid content: 60% by mass), and 98 parts of 1-methoxy-2-propanol as a solvent were placed in a sand mill using 450 parts of glass beads having a diameter of 0.8 mm, and subjected to a dispersion treatment under the dispersion treatment conditions of the number of rotation: 2000 rpm, dispersion treatment time: 4 hours, and setting temperature of the cooling water: 18° C. to obtain a dispersion liquid.

After the glass beads were removed from the dispersion liquid with a mesh, 13.8 parts of a silicone resin particle as a surface roughening material (trade name: Tospearl 120, made by Momentive Performance Materials Japan LLC, average particle diameter: 2 μm), 0.014 parts of a silicone oil as a leveling agent (trade name: SH28PA, made by Dow Corning Toray Co., Ltd.), 6 parts of methanol, and 6 parts of 1-methoxy-2-propanol were added to the dispersion liquid, and stirred to prepare a coating liquid for a conductive layer C51.

Preparation Example of Coating Liquid for Conductive Layer C52)

A coating liquid for a conductive layer was prepared by the same operation as the operation to prepare the coating liquid for a conductive layer 10 which is described in Patent Literature 2. This coating liquid was used as a coating liquid for a conductive layer C52.

Namely, 204 parts of a titanium oxide ($TiO_2$) particle coated with tin oxide ($SnO_2$) doped with tungsten (W) (powder resistivity: $2.5\times10^1$ Ω·cm, coating percentage with tin oxide ($SnO_2$): 33% by mass, amount of tungsten (W) used to dope tin oxide ($SnO_2$) (amount of dope): 3% by mass), 148 parts of a phenol resin as a biding resin (monomer/oligomer of the phenol resin) (trade name: Plyophen J-325, made by DIC Corporation, resin solid content: 60% by mass), and 98 parts of 1-methoxy-2-propanol as a solvent were placed in a sand mill using 450 parts of glass beads having a diameter of 0.8 mm, and subjected to a dispersion treatment under the dispersion treatment conditions of the number of rotation: 2000 rpm, dispersion treatment time: 4 hours, and setting temperature of cooling water: 18° C. to obtain a dispersion liquid.

After the glass beads were removed from the dispersion liquid with a mesh, 13.8 parts of a silicone resin particle as a surface roughening material (trade name: Tospearl 120, made by Momentive Performance Materials Japan LLC, average particle diameter: 2 μm), 0.014 parts of a silicone oil as a leveling agent (trade name: SH28PA, made by Dow Corning Toray Co., Ltd.), 6 parts of methanol, and 6 parts of 1-methoxy-2-propanol were added to the dispersion liquid, and stirred to prepare a coating liquid for a conductive layer C52.

(Preparation Example of Coating Liquid for Conductive Layer C53)

A coating liquid for a conductive layer was prepared by the same operation as the operation to prepare the coating liquid for a conductive layer which is described in Example 2 in Japanese Patent Application Laid-Open No. 2008-026482. This coating liquid was used as a coating liquid for a conductive layer C53.

Namely, 8.08 parts of a titanium oxide ($TiO_2$) particle coated with oxygen-defective tin oxide ($SnO_2$) (powder resistivity: $9.7\times10^2$ Ω·cm, coating percentage with tin oxide ($SnO_2$): 31% by mass), 2.02 parts of a titanium oxide ($TiO_2$) particle not subjected to a conductive treatment (average primary particle diameter: 0.60 μm), 1.80 parts of a phenol resin as a biding resin (trade name: J-325, made by DIC Corporation, resin solid content 60%), and 10.32 parts of methoxypropanol as a solvent (1-methoxy-2-propanol) were placed in a sand mill using glass beads having a diameter of 1 mm, and subjected to a dispersion treatment under the dispersion treatment condition of the dispersion treatment time: 3 hours to obtain a dispersion liquid.

0.5 Parts of as silicone resin particle as a surface roughening material (trade name: Tospearl 120, made by Momentive Performance Materials Japan LLC, average particle diameter: 2 μm), and 0.001 parts of a silicone oil as a leveling agent (trade name: SH28PA, made by Dow Corning Toray Co., Ltd.) were added to the dispersion liquid, and stirred to prepare a coating liquid for a conductive layer C53.

<Production Examples of Electrophotographic Photosensitive Member>

(Production Example of Electrophotographic Photosensitive Member 1)

A support was an aluminum cylinder having a length of 257 mm and a diameter of 24 mm and produced by a production method including extrusion and drawing (JIS-A3003, aluminum alloy).

Under an environment of normal temperature and normal humidity (23° C./50% RH), the coating liquid for a conductive layer 1 was applied onto the support by dip coating, and the obtained coating film is dried and thermally cured for 30 minutes at 140° C. to form a conductive layer having a film thickness of 30 μm.

The volume resistivity of the conductive layer was measured by the method described above, and it was $1.8\times10^{12}$ Ω·cm.

Next, 4.5 parts of N-methoxymethylated nylon (trade name: TORESIN EF-30T, made by Nagase ChemteX Corporation) and 1.5 parts of a copolymerized nylon resin (trade name: AMILAN CM8000, made by Toray Industries, Inc.) were dissolved in a mixed solvent of 65 parts of methanol/30 parts of n-butanol to prepare a coating solution for an undercoat layer. The coating solution for an undercoat layer was applied onto the conductive layer by dip coating, and the obtained coating film is dried for 6 minutes at 70° C. to form an undercoat layer having a film thickness of 0.85 μm.

Next, 10 parts of crystalline hydroxy gallium phthalocyanine crystals (charge-generating substance) having strong peaks at Bragg angles (2θ±0.2° of 7.5°, 9.9°, 16.3°, 18.6°, 25.1°, and 28.3° in CuKα properties X ray diffraction, 5 parts of polyvinyl butyral (trade name: S-LECBX-1, made by Sekisui Chemical Co., Ltd.), and 250 parts of cyclohexanone were placed in a sand mill using glass beads having a diameter of 0.8 mm. The solution was dispersed under a condition: dispersing time, 3 hours. Next, 250 parts of ethyl acetate was added to the solution to prepare a coating solution for a charge-generating layer. The coating solution for a charge-generating layer was applied onto the undercoat layer by dip coating, and the obtained coating film is dried for 10 minutes at 100° C. to form a charge-generating layer having a film thickness of 0.15 μm.

Next, 6.0 parts of an amine compound represented by the following formula (CT-1) (charge transport substance), (CT-1)

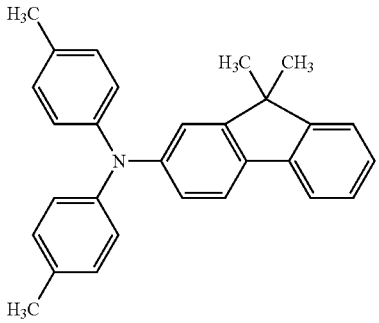

2.0 parts of an amine compound represented by the following formula (CT-2) (charge transport substance), (CT-2)

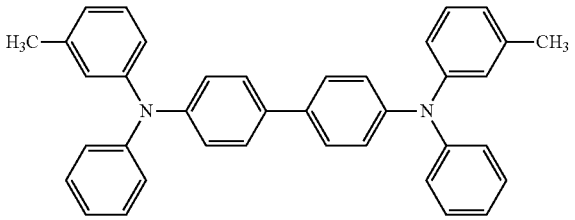

10 parts of bisphenol Z type polycarbonate (trade name: Z400, made by Mitsubishi Engineering-Plastics Corporation), and 0.36 parts of siloxane modified polycarbonate having the repeating structure unit represented by the following formula (B-1) ((B-1):(B-2)=95:5 (molar ratio)), the repeating structure unit represented by the following formula (B-2), and the terminal structure represented by the following formula (B-3):

(B-1)

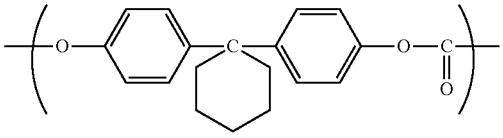

(B-2)

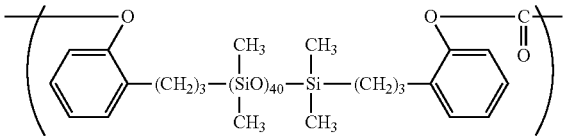

(B-3)

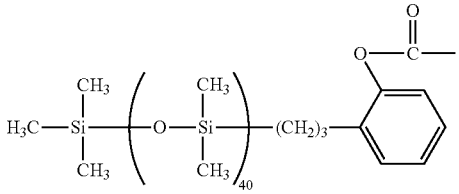

were dissolved in a mixed solvent of 60 parts of o-xylene/40 parts of dimethoxymethane/2.7 parts of methyl benzoate to prepare a coating solution for a charge transport layer. The coating solution for a charge transport layer was applied onto a charge-generating layer by dipping, and the obtained coating film was dried for 30 minutes at 125° C. Thereby, a charge transport layer having a film thickness of 10.0 μm was formed.

Thus, an electrophotographic photosensitive member 1 in which the charge transport layer was the surface layer was produced.

(Production Examples of Electrophotographic Photosensitive Members 2 to 78 and C1 to C71)

Electrophotographic photosensitive members 2 to 78 and C1 to C71 in which the charge transport layer was the surface layer were produced by the same operation as that in Production Example of the electrophotographic photosensitive member 1 except that the coating liquid for a conductive layer used in production of the electrophotographic photosensitive member was changed from the coating liquid for a conductive layer 1 to each of the coating liquids for a conductive layer 2 to 78 and C1 to C71. The volume resistivity of the conductive layer was measured in the same manner as in the case of the electrophotographic photosensitive member 1. The results are shown in Tables 8 to 14.

In the electrophotographic photosensitive members 1 to 78 and C1 to C71, two electrophotographic photosensitive members were produced: one for the conductive layer analysis and the other for the sheet feeding durability test.

(Production Examples of Electrophotographic Photosensitive Members 101 to 178 and C101 to C171)

As the electrophotographic photosensitive member for the probe pressure resistance test, electrophotographic photosensitive members 101 to 178 and C101 to C171 in which the charge transport layer was the surface layer were produced by the same operation as that in Production Examples of electrophotographic photosensitive members 1 to 78 and C1 to C71 except that the film thickness of the charge transport layer was 5.0 μm.

Examples 1 to 78 and Comparative Examples 1 to 71

<Analysis of Conductive Layer in Electrophotographic Photosensitive Member>

Five pieces of a 5 mm square were cut from each of the electrophotographic photosensitive members 1 to 78 and C1 to C71 for the conductive layer analysis. Subsequently, the charge transport layers and charge-generating layers on the respective pieces were removed with chlorobenzene, methyl ethyl ketone, and methanol to expose the conductive layer. Thus, five sample pieces for observation were prepared for each of the electrophotographic photosensitive members.

First, for each of the electrophotographic photosensitive members, using one sample piece and a focused ion beam processing observation apparatus (trade name: FB-2000A, made by Hitachi High-Tech Manufacturing & Service Corporation), the conductive layer was sliced into a thickness: 150 nm according to an FIB-μ sampling method. Using a field emission electron microscope (HRTEM) (trade name: JEM-2100F, made by JEOL, Ltd.) and an energy dispersive X-ray spectrometer (EDX) (trade name: JED-2300T, made by JEOL, Ltd.), the conductive layer was subjected to the composition analysis. The measurement conditions of the EDX are an accelerating voltage: 200 kV and a beam diameter: 1.0 nm.

As a result, it was found that the conductive layers in the electrophotographic photosensitive members 1 to 18, C1 to C9, C48 and C51 contained the titanium oxide particle coated with tin oxide doped with phosphorus. It was also found that the conductive layers in the electrophotographic photosensitive members 19 to 30, C10 to C18, C49 and C52 contained the titanium oxide particle coated with tin oxide doped with tungsten. It was also found that the conductive layers in the electrophotographic photosensitive members 31 to 42, C19 to C27 and C50 contained the titanium oxide particle coated with tin oxide doped with fluorine. It was also found that the conductive layers in the electrophotographic photosensitive members C28 to C37 contained the titanium oxide particle coated with tin oxide doped with antimony. It was also found that the conductive layers in the electrophotographic photosensitive members C38 to C47 and C53 contained the titanium oxide particle coated with tin oxide. It was also found that the electrophotographic photosensitive members 43 to 60 and C54 to 62 contained the titanium oxide particle coated with tin oxide doped with niobium. It was also found that the electrophotographic photosensitive members 61 to 78 and C63 to 71 contained the titanium oxide particle coated with tin oxide doped with niobium. It was also found that the conductive layers in all of the electrophotographic photosensitive members except the electrophotographic photosensitive members C3, C12, C21, C56, C65 and C48 to C53 contained the uncoated titanium oxide particle.

Next, for each of the electrophotographic photosensitive members, using the remaining four sample pieces, the conductive layer was formed into a three-dimensional image of 2 μm×2 μm×2 μm by the FIB-SEM Slice & View.

From the difference in contrast in the FIB-SEM Slice & View, tin oxide and titanium oxide doped with phosphorus can be identified, and the volume of the titanium oxide particle coated with P-doped tin oxide, the volume of the P-doped tin oxide particle, and the ratio thereof in the conductive layer can be determined. When the kind of elements used to dope tin oxide is other than phosphorus, for example, tungsten, fluorine, niobium, and tantalum, the volumes and the ratio thereof in the conductive layer can be determined in the same manner.

The conditions of the Slice & View in the present invention were as follows.

processing of the sample for analysis: FIB method processing and observation apparatus: made by SII/Zeiss, NVision 40 slice interval: 10 nm observation condition:

accelerating voltage: 1.0 kV inclination of the sample: 54°

WD: 5 mm detector: BSE detector aperture: 60 μm, high current

ABC: ON resolution of the image: 1.25 nm/pixel

The analysis is performed on the area measuring 2 μm×2 μm. The information for every cross section is integrated to determine the volumes $V_1$ and $V_2$ per 2 μm×2 μm×2 μm ($V_T$=8 $\mu m^3$). The measurement environment is the temperature: 23° C. and the pressure: $1\times10^{-4}$ Pa.

For the processing and observation apparatus, Strata 400S made by FEI Company (inclination of the sample: 52°) can also be used.

The information for every cross section was obtained by analyzing the images of the areas of identified tin oxide doped with phosphorus and titanium oxide. The image was analyzed using the following image processing software.

image processing software: made by Media Cybernetics, Inc., Image-Pro Plus

Based on the obtained information, for the four sample pieces, the volume of the first metal oxide particle ($V_T$ [$\mu m^3$]) and the volume of the second metal oxide particle (uncoated titanium oxide particle) ($V_2$ [$\mu m^3$]) in the volume of 2 μm×2 μm×2 μm (unit volume: 8 $\mu m^3$) were obtained. Then, ($V_1$ [$\mu m^3$]/8 [$\mu m^3$])×100, ($V_2$ [$\mu m^3$]/8 [$\mu m^3$])×100, and ($V_2$ [$\mu m^3$]/$V_1$ [$\mu m^3$])×100 were calculated. The average value of the values of ($V_1$ [$\mu m^3$]/8 [$\mu m^3$])×100 in the four sample pieces was defined as the content [% by volume] of the first metal oxide particle in the conductive layer based on the total volume of the conductive layer. The average value of the values of ($V_2$ [$\mu m^3$]/8 [$\mu m^3$])×100 in the four sample pieces was defined as the content [% by volume] of the second metal oxide particle in the conductive layer based on the total volume of the conductive layer. The average value of the values of ($V_2$ [$\mu m^3$]/$V_1$ [$\mu m^3$])×100 in the four sample pieces was defined as the content [% by volume] of the second metal oxide particle in the conductive layer based on the content of the first metal oxide particle in the conductive layer.

In the four sample pieces, the average primary particle diameter of the first metal oxide particle and the average primary particle diameter of the second metal oxide particle (uncoated titanium oxide particle) were determined as described above. The average value of the average primary particle diameters of the first metal oxide particle in the four sample pieces was defined as the average primary particle diameter ($D_1$) of the first metal oxide particle in the conductive layer. The average value of the average primary particle diameters of the second metal oxide particle in the four sample pieces was defined as the average primary particle diameter ($D_2$) of the second metal oxide particle in the conductive layer.

The results are shown in Tables 8 to 14.

TABLE 8

| Example | Coating solution for conductive layer | Electrophotographic photosensitive member | Content [% by volume] of the first metal oxide particle in the conductive layer based on the total volume of the conductive layer | Content [% by volume] of the second metal oxide particle in the conductive layer based on the total volume of the conductive layer | Content [% by volume] of the second metal oxide particle in the conductive layer based on the content of the first metal oxide particle in the conductive layer | Average primary particle diameter ($D_1$) of the first metal oxide particle in the conductive layer [μm] | Average primary particle diameter ($D_2$) of the second metal oxide particle in the conductive layer [μm] | $D_1/D_2$ | Volume resistivity of the conductive layer [Ω · cm] |
|---|---|---|---|---|---|---|---|---|---|
| 1 | 1 | 1 | 21 | 1.1 | 5.1 | 0.20 | 0.20 | 1.0 | $1.8 \times 10^{12}$ |
| 2 | 2 | 2 | 20 | 4.1 | 20 | 0.20 | 0.20 | 1.0 | $2.0 \times 10^{12}$ |
| 3 | 3 | 3 | 20 | 5.9 | 30 | 0.20 | 0.20 | 1.0 | $2.5 \times 10^{12}$ |
| 4 | 4 | 4 | 35 | 1.8 | 5.1 | 0.20 | 0.20 | 1.0 | $5.0 \times 10^{10}$ |
| 5 | 5 | 5 | 35 | 3.0 | 8.7 | 0.20 | 0.20 | 1.0 | $5.0 \times 10^{10}$ |
| 6 | 6 | 6 | 48 | 4.8 | 10 | 0.20 | 0.20 | 1.0 | $4.5 \times 10^{8}$ |
| 7 | 7 | 7 | 49 | 2.5 | 5.0 | 0.20 | 0.20 | 1.0 | $4.5 \times 10^{8}$ |
| 8 | 8 | 8 | 34 | 4.9 | 14 | 0.20 | 0.20 | 1.0 | $1.0 \times 10^{11}$ |
| 9 | 9 | 9 | 33 | 8.4 | 26 | 0.20 | 0.20 | 1.0 | $5.8 \times 10^{11}$ |
| 10 | 10 | 10 | 47 | 9.8 | 21 | 0.20 | 0.20 | 1.0 | $5.0 \times 10^{8}$ |
| 11 | 11 | 11 | 46 | 14.1 | 30 | 0.20 | 0.20 | 1.0 | $7.0 \times 10^{8}$ |
| 12 | 12 | 12 | 35 | 1.8 | 5.1 | 0.45 | 0.20 | 2.3 | $5.0 \times 10^{10}$ |
| 13 | 13 | 13 | 35 | 1.8 | 5.1 | 0.45 | 0.40 | 1.1 | $5.0 \times 10^{10}$ |
| 14 | 14 | 14 | 35 | 1.8 | 5.1 | 0.15 | 0.15 | 1.0 | $5.0 \times 10^{10}$ |
| 15 | 15 | 15 | 35 | 1.8 | 5.1 | 0.15 | 0.10 | 1.5 | $5.0 \times 10^{10}$ |
| 16 | 16 | 16 | 35 | 3.0 | 8.6 | 0.20 | 0.20 | 1.0 | $3.2 \times 10^{9}$ |
| 17 | 17 | 17 | 35 | 3.0 | 8.6 | 0.20 | 0.20 | 1.0 | $2.2 \times 10^{11}$ |
| 18 | 18 | 18 | 20 | 3.5 | 17 | 0.20 | 0.18 | 1.0 | $2.0 \times 10^{11}$ |

TABLE 9

| Example | Coating solution for conductive layer | Electrophotographic photosensitive member | Content [% by volume] of the first metal oxide particle in the conductive layer based on the total volume of the conductive layer | Content [% by volume] of the second metal oxide particle in the conductive layer based on the total volume of the conductive layer | Content [% by volume] of the second metal oxide particle in the conductive layer based on the content of the first metal oxide particle in the conductive layer | Average primary particle diameter ($D_1$) of the first metal oxide particle in the conductive layer [μm] | Average primary particle diameter ($D_2$) of the second metal oxide particle in the conductive layer [μm] | $D_1/D_2$ | Volume resistivity of the conductive layer [Ω · cm] |
|---|---|---|---|---|---|---|---|---|---|
| 19 | 19 | 19 | 20 | 1.5 | 7.5 | 0.20 | 0.20 | 1.0 | $1.8 \times 10^{12}$ |
| 20 | 20 | 20 | 35 | 1.8 | 5.1 | 0.20 | 0.20 | 1.0 | $5.0 \times 10^{10}$ |
| 21 | 21 | 21 | 34 | 2.9 | 8.6 | 0.20 | 0.20 | 1.0 | $5.0 \times 10^{10}$ |
| 22 | 22 | 22 | 50 | 5.0 | 10 | 0.20 | 0.20 | 1.0 | $4.7 \times 10^{8}$ |
| 23 | 23 | 23 | 34 | 5.0 | 15 | 0.20 | 0.20 | 1.0 | $1.8 \times 10^{11}$ |
| 24 | 24 | 24 | 32 | 8.0 | 25 | 0.20 | 0.20 | 1.0 | $5.6 \times 10^{11}$ |
| 25 | 25 | 25 | 47 | 9.4 | 20 | 0.20 | 0.20 | 1.0 | $5.0 \times 10^{8}$ |
| 26 | 26 | 26 | 45 | 13 | 30 | 0.20 | 0.20 | 1.0 | $7.0 \times 10^{8}$ |
| 27 | 27 | 27 | 35 | 3.0 | 8.6 | 0.45 | 0.20 | 2.3 | $5.0 \times 10^{10}$ |
| 28 | 28 | 28 | 35 | 3.0 | 8.6 | 0.45 | 0.40 | 1.1 | $5.0 \times 10^{10}$ |
| 29 | 29 | 29 | 35 | 3.0 | 8.6 | 0.15 | 0.15 | 1.0 | $5.0 \times 10^{10}$ |
| 30 | 30 | 30 | 35 | 3.0 | 8.6 | 0.15 | 0.10 | 1.5 | $5.0 \times 10^{10}$ |
| 31 | 31 | 31 | 20 | 1.5 | 7.5 | 0.20 | 0.20 | 1.0 | $2.0 \times 10^{12}$ |
| 32 | 32 | 32 | 35 | 1.8 | 5.1 | 0.20 | 0.20 | 1.0 | $5.5 \times 10^{10}$ |
| 33 | 33 | 33 | 34 | 2.9 | 8.6 | 0.20 | 0.20 | 1.0 | $5.5 \times 10^{10}$ |

TABLE 9-continued

| Example | Coating solution for conductive layer | Electrophotographic photo-sensitive member | Content [% by volume] of the first metal oxide particle in the conductive layer based on the total volume of the conductive layer | Content [% by volume] of the second metal oxide particle in the conductive layer based on the total volume of the conductive layer | Content [% by volume] of the second metal oxide particle in the conductive layer based on the content of the first metal oxide particle in the conductive layer | Average primary particle diameter ($D_1$) of the first metal oxide particle in the conductive layer [μm] | Average primary particle diameter ($D_2$) of the second metal oxide particle in the conductive layer [μm] | $D_1/D_2$ | Volume resistivity of the conductive layer [Ω · cm] |
|---|---|---|---|---|---|---|---|---|---|
| 34 | 34 | 34 | 50 | 5.0 | 10 | 0.20 | 0.20 | 1.0 | $5.3 \times 10^{8}$ |
| 35 | 35 | 35 | 34 | 4.8 | 14 | 0.20 | 0.20 | 1.0 | $2.2 \times 10^{11}$ |
| 36 | 36 | 36 | 32 | 8.3 | 26 | 0.20 | 0.20 | 1.0 | $6.5 \times 10^{11}$ |
| 37 | 37 | 37 | 48 | 9.7 | 20 | 0.20 | 0.20 | 1.0 | $5.5 \times 10^{8}$ |
| 38 | 38 | 38 | 46 | 13.7 | 30 | 0.20 | 0.20 | 1.0 | $7.8 \times 10^{8}$ |
| 39 | 39 | 39 | 34 | 3.1 | 8.9 | 0.45 | 0.20 | 2.3 | $5.5 \times 10^{10}$ |
| 40 | 40 | 40 | 34 | 3.1 | 8.9 | 0.45 | 0.40 | 1.1 | $5.5 \times 10^{10}$ |
| 41 | 41 | 41 | 34 | 3.1 | 8.9 | 0.15 | 0.15 | 1.0 | $5.5 \times 10^{10}$ |
| 42 | 42 | 42 | 34 | 3.1 | 8.9 | 0.15 | 0.10 | 1.5 | $5.5 \times 10^{10}$ |

TABLE 10

| Example | Coating solution for conductive layer | Electrophotographic photo-sensitive member | Content [% by volume] of the first metal oxide particle in the conductive layer based on the total volume of the conductive layer | Content [% by volume] of the second metal oxide particle in the conductive layer based on the total volume of the conductive layer | Content [% by volume] of the second metal oxide particle in the conductive layer based on the content of the first metal oxide particle in the conductive layer | Average primary particle diameter ($D_1$) of the first metal oxide particle in the conductive layer [μm] | Average primary particle diameter ($D_2$) of the second metal oxide particle in the conductive layer [μm] | $D_1/D_2$ | Volume resistivity of the conductive layer [Ω · cm] |
|---|---|---|---|---|---|---|---|---|---|
| 43 | 43 | 43 | 21 | 1.1 | 5.1 | 0.20 | 0.20 | 1.0 | $1.8 \times 10^{12}$ |
| 44 | 44 | 44 | 20 | 4.1 | 20 | 0.20 | 0.20 | 1.0 | $2.0 \times 10^{12}$ |
| 45 | 45 | 45 | 20 | 5.9 | 30 | 0.20 | 0.20 | 1.0 | $2.5 \times 10^{12}$ |
| 46 | 46 | 46 | 35 | 1.8 | 5.1 | 0.20 | 0.20 | 1.0 | $5.0 \times 10^{10}$ |
| 47 | 47 | 47 | 35 | 3.0 | 8.7 | 0.20 | 0.20 | 1.0 | $5.0 \times 10^{10}$ |
| 48 | 48 | 48 | 48 | 4.8 | 10 | 0.20 | 0.20 | 1.0 | $4.5 \times 10^{8}$ |
| 49 | 49 | 49 | 49 | 2.5 | 5.0 | 0.20 | 0.20 | 1.0 | $4.5 \times 10^{8}$ |
| 50 | 50 | 50 | 34 | 4.9 | 14 | 0.20 | 0.20 | 1.0 | $1.0 \times 10^{11}$ |
| 51 | 51 | 51 | 33 | 8.4 | 26 | 0.20 | 0.20 | 1.0 | $5.8 \times 10^{11}$ |
| 52 | 52 | 52 | 47 | 9.8 | 21 | 0.20 | 0.20 | 1.0 | $5.0 \times 10^{8}$ |
| 53 | 53 | 53 | 46 | 13 | 29 | 0.20 | 0.20 | 1.0 | $7.0 \times 10^{8}$ |
| 54 | 54 | 54 | 35 | 1.8 | 5.1 | 0.45 | 0.20 | 2.3 | $5.0 \times 10^{10}$ |
| 55 | 55 | 55 | 35 | 1.8 | 5.1 | 0.45 | 0.40 | 1.1 | $5.0 \times 10^{10}$ |
| 56 | 56 | 56 | 35 | 1.8 | 5.1 | 0.15 | 0.15 | 1.0 | $5.0 \times 10^{10}$ |
| 57 | 57 | 57 | 35 | 1.8 | 5.1 | 0.15 | 0.10 | 1.5 | $5.0 \times 10^{10}$ |
| 58 | 58 | 58 | 35 | 3.0 | 8.6 | 0.20 | 0.20 | 1.0 | $3.2 \times 10^{9}$ |
| 59 | 59 | 59 | 35 | 3.0 | 8.6 | 0.20 | 0.20 | 1.0 | $2.2 \times 10^{11}$ |
| 60 | 60 | 60 | 20 | 3.5 | 17 | 0.20 | 0.20 | 1.0 | $2.0 \times 10^{11}$ |

TABLE 11

| Example | Coating solution for conductive layer | Electrophotographic photosensitive member | Content [% by volume] of the first metal oxide particle in the conductive layer based on the total volume of the conductive layer | Content [% by volume] of the second metal oxide particle in the conductive layer based on the total volume of the conductive layer | Content [% by volume] of the second metal oxide particle in the conductive layer based on the content of the first metal oxide particle in the conductive layer | Average primary particle diameter ($D_1$) of the first metal oxide particle in the conductive layer [μm] | Average primary particle diameter ($D_2$) of the second metal oxide particle in the conductive layer [μm] | $D_1/D_2$ | Volume resistivity of the conductive layer [Ω · cm] |
|---|---|---|---|---|---|---|---|---|---|
| 61 | 61 | 61 | 21 | 1.1 | 5.2 | 0.20 | 0.20 | 1.0 | $1.8 \times 10^{12}$ |
| 62 | 62 | 62 | 20 | 4.1 | 21 | 0.20 | 0.20 | 1.0 | $2.0 \times 10^{12}$ |
| 63 | 63 | 63 | 20 | 5.9 | 30 | 0.20 | 0.20 | 1.0 | $2.5 \times 10^{12}$ |
| 64 | 64 | 64 | 35 | 1.8 | 5.1 | 0.20 | 0.20 | 1.0 | $5.0 \times 10^{10}$ |
| 65 | 65 | 65 | 34 | 3.0 | 8.9 | 0.20 | 0.20 | 1.0 | $5.0 \times 10^{10}$ |
| 66 | 66 | 66 | 48 | 4.8 | 10 | 0.20 | 0.20 | 1.0 | $4.5 \times 10^{8}$ |
| 67 | 67 | 67 | 49 | 2.4 | 5.0 | 0.20 | 0.20 | 1.0 | $4.5 \times 10^{8}$ |
| 68 | 68 | 68 | 34 | 4.8 | 14 | 0.20 | 0.20 | 1.0 | $1.0 \times 10^{11}$ |
| 69 | 69 | 69 | 32 | 8.3 | 26 | 0.20 | 0.20 | 1.0 | $5.8 \times 10^{11}$ |
| 70 | 70 | 70 | 47 | 10 | 21 | 0.20 | 0.20 | 1.0 | $5.0 \times 10^{8}$ |
| 71 | 71 | 71 | 45 | 13 | 30 | 0.20 | 0.20 | 1.0 | $7.0 \times 10^{8}$ |
| 72 | 72 | 72 | 35 | 1.8 | 5.1 | 0.45 | 0.20 | 2.3 | $5.0 \times 10^{10}$ |
| 73 | 73 | 73 | 35 | 1.8 | 5.1 | 0.45 | 0.40 | 1.1 | $5.0 \times 10^{10}$ |
| 74 | 74 | 74 | 35 | 1.8 | 5.1 | 0.15 | 0.15 | 1.0 | $5.0 \times 10^{10}$ |
| 75 | 75 | 75 | 35 | 1.8 | 5.1 | 0.15 | 0.10 | 1.5 | $5.0 \times 10^{10}$ |
| 76 | 76 | 76 | 34 | 2.9 | 8.6 | 0.20 | 0.20 | 1.0 | $3.2 \times 10^{9}$ |
| 77 | 77 | 77 | 34 | 2.9 | 8.6 | 0.20 | 0.20 | 1.0 | $2.2 \times 10^{11}$ |
| 78 | 78 | 78 | 20 | 3.5 | 17 | 0.20 | 0.20 | 1.0 | $2.0 \times 10^{11}$ |

TABLE 12

| Example | Coating solution for conductive layer | Electrophotographic photosensitive member | Content [% by volume] of the first metal oxide particle in the conductive layer based on the total volume of the conductive layer | Content [% by volume] of the second metal oxide particle in the conductive layer based on the total volume of the conductive layer | Content [% by volume] of the second metal oxide particle in the conductive layer based on the content of the first metal oxide particle in the conductive layer | Average primary particle diameter ($D_1$) of the first metal oxide particle in the conductive layer [μm] | Average primary particle diameter ($D_2$) of the second metal oxide particle in the conductive layer [μm] | $D_1/D_2$ | Volume resistivity of the conductive layer [Ω · cm] |
|---|---|---|---|---|---|---|---|---|---|
| 1 | C1 | C1 | 15 | 1.5 | 10 | 0.20 | 0.20 | 1.0 | $5.0 \times 10^{12}$ |
| 2 | C2 | C2 | 54 | 4.9 | 9.1 | 0.20 | 0.20 | 1.0 | $2.2 \times 10^{8}$ |
| 3 | C3 | C3 | 35 | — | — | 0.20 | — | — | $5.0 \times 10^{10}$ |
| 4 | C4 | C4 | 35 | 0.5 | 1.4 | 0.20 | 0.20 | 1.0 | $5.0 \times 10^{10}$ |
| 5 | C5 | C5 | 50 | 0.5 | 1.0 | 0.20 | 0.20 | 1.0 | $4.5 \times 10^{8}$ |
| 6 | C6 | C6 | 32 | 20 | 62 | 0.20 | 0.20 | 1.0 | $6.7 \times 10^{10}$ |
| 7 | C7 | C7 | 40 | 20 | 50 | 0.20 | 0.20 | 1.0 | $5.8 \times 10^{8}$ |
| 8 | C8 | C8 | 34 | 1.5 | 4.3 | 0.20 | 0.20 | 1.0 | $5.0 \times 10^{10}$ |
| 9 | C9 | C9 | 31 | 11 | 34 | 0.20 | 0.20 | 1.0 | $6.0 \times 10^{10}$ |
| 10 | C10 | C10 | 15 | 1.5 | 10 | 0.20 | 0.20 | 1.0 | $5.0 \times 10^{12}$ |
| 11 | C11 | C11 | 54 | 5.0 | 9.3 | 0.20 | 0.20 | 1.0 | $2.2 \times 10^{8}$ |
| 12 | C12 | C12 | 35 | — | — | 0.20 | — | — | $5.0 \times 10^{10}$ |
| 13 | C13 | C13 | 35 | 0.5 | 1.4 | 0.20 | 0.20 | 1.0 | $5.0 \times 10^{10}$ |
| 14 | C14 | C14 | 50 | 0.5 | 1.0 | 0.20 | 0.20 | 1.0 | $4.5 \times 10^{8}$ |
| 15 | C15 | C15 | 32 | 20 | 64 | 0.20 | 0.20 | 1.0 | $6.7 \times 10^{10}$ |
| 16 | C16 | C16 | 40 | 20 | 50 | 0.20 | 0.20 | 1.0 | $5.8 \times 10^{8}$ |

TABLE 12-continued

| Example | Coating solution for conductive layer | Electrophotographic photosensitive member | Content [% by volume] of the first metal oxide particle in the conductive layer based on the total volume of the conductive layer | Content [% by volume] of the second metal oxide particle in the conductive layer based on the total volume of the conductive layer | Content [% by volume] of the second metal oxide particle in the conductive layer based on the content of the first metal oxide particle in the conductive layer | Average primary particle diameter ($D_1$) of the first metal oxide particle in the conductive layer [μm] | Average primary particle diameter ($D_2$) of the second metal oxide particle in the conductive layer [μm] | $D_1/D_2$ | Volume resistivity of the conductive layer [Ω · cm] |
|---|---|---|---|---|---|---|---|---|---|
| 17 | C17 | C17 | 35 | 1.0 | 2.9 | 0.20 | 0.20 | 1.0 | $5.0 \times 10^{10}$ |
| 18 | C18 | C18 | 31 | 11 | 34 | 0.20 | 0.20 | 1.0 | $6.0 \times 10^{10}$ |
| 19 | C19 | C19 | 15 | 1.5 | 10 | 0.20 | 0.20 | 1.0 | $6.0 \times 10^{12}$ |
| 20 | C20 | C20 | 55 | 5.0 | 9.1 | 0.20 | 0.20 | 1.0 | $2.5 \times 10^{8}$ |
| 21 | C21 | C21 | 35 | — | — | 0.20 | — | — | $5.5 \times 10^{10}$ |
| 22 | C22 | C22 | 35 | 0.5 | 1.4 | 0.20 | 0.20 | 1.0 | $5.5 \times 10^{10}$ |
| 23 | C23 | C23 | 50 | 0.5 | 1.0 | 0.20 | 0.20 | 1.0 | $4.8 \times 10^{8}$ |
| 24 | C24 | C24 | 31 | 22 | 71 | 0.20 | 0.20 | 1.0 | $7.3 \times 10^{10}$ |
| 25 | C25 | C25 | 40 | 20 | 50 | 0.20 | 0.20 | 1.0 | $6.2 \times 10^{8}$ |
| 26 | C26 | C26 | 35 | 1.0 | 2.9 | 0.20 | 0.20 | 1.0 | $5.5 \times 10^{10}$ |
| 27 | C27 | C27 | 31 | 11 | 34 | 0.20 | 0.20 | 1.0 | $6.5 \times 10^{10}$ |

TABLE 13

| Example | Coating solution for conductive layer | Electrophotographic photosensitive member | Content [% by volume] of the first metal oxide particle in the conductive layer based on the total volume of the conductive layer | Content [% by volume] of the second metal oxide particle in the conductive layer based on the total volume of the conductive layer | Content [% by volume] of the second metal oxide particle in the conductive layer based on the content of the first metal oxide particle in the conductive layer | Average primary particle diameter ($D_1$) of the first metal oxide particle in the conductive layer [μm] | Average primary particle diameter ($D_2$) of the second metal oxide particle in the conductive layer [μm] | $D_1/D_2$ | Volume resistivity of the conductive layer [Ω · cm] |
|---|---|---|---|---|---|---|---|---|---|
| 28 | C28 | C28 | 20 | 1.5 | 7.5 | 0.20 | 0.20 | 1.0 | $1.8 \times 10^{12}$ |
| 29 | C29 | C29 | 34 | 1.8 | 5.1 | 0.20 | 0.20 | 1.0 | $5.0 \times 10^{10}$ |
| 30 | C30 | C30 | 34 | 2.9 | 8.6 | 0.20 | 0.20 | 1.0 | $5.0 \times 10^{10}$ |
| 31 | C31 | C31 | 48 | 4.8 | 10 | 0.20 | 0.20 | 1.0 | $4.5 \times 10^{8}$ |
| 32 | C32 | C32 | 35 | 5.0 | 14 | 0.20 | 0.20 | 1.0 | $1.0 \times 10^{11}$ |
| 33 | C33 | C33 | 33 | 8.6 | 26 | 0.20 | 0.20 | 1.0 | $5.8 \times 10^{11}$ |
| 34 | C34 | C34 | 47 | 9.8 | 21 | 0.20 | 0.20 | 1.0 | $5.0 \times 10^{8}$ |
| 35 | C35 | C35 | 46 | 13 | 29 | 0.20 | 0.20 | 1.0 | $7.0 \times 10^{8}$ |
| 36 | C36 | C36 | 35 | 3.0 | 8.6 | 0.45 | 0.40 | 1.1 | $5.0 \times 10^{10}$ |
| 37 | C37 | C37 | 35 | 3.0 | 8.6 | 0.15 | 0.15 | 1.0 | $5.0 \times 10^{10}$ |
| 38 | C38 | C38 | 20 | 1.5 | 7.5 | 0.20 | 0.20 | 1.0 | $1.8 \times 10^{12}$ |
| 39 | C39 | C39 | 34 | 1.8 | 5.1 | 0.20 | 0.20 | 1.0 | $5.0 \times 10^{10}$ |
| 40 | C40 | C40 | 34 | 2.9 | 8.6 | 0.20 | 0.20 | 1.0 | $5.0 \times 10^{10}$ |
| 41 | C41 | C41 | 48 | 4.8 | 10 | 0.20 | 0.20 | 1.0 | $4.5 \times 10^{8}$ |
| 42 | C42 | C42 | 35 | 5.0 | 14 | 0.20 | 0.20 | 1.0 | $1.0 \times 10^{11}$ |
| 43 | C43 | C43 | 33 | 8.6 | 26 | 0.20 | 0.20 | 1.0 | $5.8 \times 10^{11}$ |
| 44 | C44 | C44 | 48 | 9.5 | 20 | 0.20 | 0.20 | 1.0 | $5.0 \times 10^{8}$ |
| 45 | C45 | C45 | 46 | 13 | 29 | 0.20 | 0.20 | 1.0 | $7.0 \times 10^{8}$ |
| 46 | C46 | C46 | 35 | 3.0 | 8.6 | 0.45 | 0.40 | 1.1 | $5.0 \times 10^{10}$ |
| 47 | C47 | C47 | 35 | 3.0 | 8.6 | 0.15 | 0.15 | 1.0 | $5.0 \times 10^{10}$ |
| 48 | C48 | C48 | 35 | — | — | 0.15 | — | — | $3.5 \times 10^{10}$ |
| 49 | C49 | C49 | 29 | — | — | 0.15 | — | — | $2.0 \times 10^{13}$ |
| 50 | C50 | C50 | 37 | — | — | 0.08 | — | — | $3.5 \times 10^{10}$ |

TABLE 13-continued

| Example | Coating solution for conductive layer | Electrophotographic photosensitive member | Content [% by volume] of the first metal oxide particle in the conductive layer based on the total volume of the conductive layer | Content [% by volume] of the second metal oxide particle in the conductive layer based on the total volume of the conductive layer | Content [% by volume] of the second metal oxide particle in the conductive layer based on the content of the first metal oxide particle in the conductive layer | Average primary particle diameter ($D_1$) of the first metal oxide particle in the conductive layer [μm] | Average primary particle diameter ($D_2$) of the second metal oxide particle in the conductive layer [μm] | $D_1/D_2$ | Volume resistivity of the conductive layer [Ω · cm] |
|---|---|---|---|---|---|---|---|---|---|
| 51 | C51 | C51 | 32 | — | — | 0.35 | — | — | $2.1 \times 10^9$ |
| 52 | C52 | C52 | 32 | — | — | 0.38 | — | — | $4.0 \times 10^9$ |
| 53 | C53 | C53 | 34 | — | — | 0.16 | — | — | $1.2 \times 10^9$ |

TABLE 14

| Example | Coating solution for conductive layer | Electrophotographic photosensitive member | Content [% by volume] of the first metal oxide particle in the conductive layer based on the total volume of the conductive layer | Content [% by volume] of the second metal oxide particle in the conductive layer based on the total volume of the conductive layer | Content [% by volume] of the second metal oxide particle in the conductive layer based on the content of the first metal oxide particle in the conductive layer | Average primary particle diameter ($D_1$) of the first metal oxide particle in the conductive layer [μm] | Average primary particle diameter ($D_2$) of the second metal oxide particle in the conductive layer [μm] | $D_1/D_2$ | Volume resistivity of the conductive layer [Ω · cm] |
|---|---|---|---|---|---|---|---|---|---|
| 54 | C54 | C54 | 16 | 1.5 | 10 | 0.20 | 0.20 | 1.0 | $5.0 \times 10^{12}$ |
| 55 | C55 | C55 | 54 | 4.9 | 9.1 | 0.20 | 0.20 | 1.0 | $2.2 \times 10^8$ |
| 56 | C56 | C56 | 35 | — | — | 0.20 | — | — | $5.0 \times 10^{10}$ |
| 57 | C57 | C57 | 35 | 0.5 | 1.4 | 0.20 | 0.20 | 1.0 | $5.0 \times 10^{10}$ |
| 58 | C58 | C58 | 50 | 0.5 | 1.0 | 0.20 | 0.20 | 1.0 | $4.5 \times 10^8$ |
| 59 | C59 | C59 | 32 | 20 | 62 | 0.20 | 0.20 | 1.0 | $6.7 \times 10^{10}$ |
| 60 | C60 | C60 | 40 | 20 | 50 | 0.20 | 0.20 | 1.0 | $5.8 \times 10^8$ |
| 61 | C61 | C61 | 34 | 1.5 | 4.3 | 0.20 | 0.20 | 1.0 | $5.0 \times 10^{10}$ |
| 62 | C62 | C62 | 31 | 11 | 34 | 0.20 | 0.20 | 1.0 | $6.0 \times 10^{10}$ |
| 63 | C63 | C63 | 15 | 1.5 | 10 | 0.20 | 0.20 | 1.0 | $5.0 \times 10^{12}$ |
| 64 | C64 | C64 | 54 | 5.0 | 9.3 | 0.20 | 0.20 | 1.0 | $2.2 \times 10^8$ |
| 65 | C65 | C65 | 35 | — | — | 0.20 | — | — | $5.0 \times 10^{10}$ |
| 66 | C66 | C66 | 35 | 0.5 | 1.4 | 0.20 | 0.20 | 1.0 | $5.0 \times 10^{10}$ |
| 67 | C67 | C67 | 50 | 0.5 | 1.0 | 0.20 | 0.20 | 1.0 | $4.5 \times 10^8$ |
| 68 | C68 | C68 | 32 | 20 | 64 | 0.20 | 0.20 | 1.0 | $6.7 \times 10^{10}$ |
| 69 | C69 | C69 | 40 | 20 | 50 | 0.20 | 0.20 | 1.0 | $5.8 \times 10^8$ |
| 70 | C70 | C70 | 35 | 1.0 | 2.9 | 0.20 | 0.20 | 1.0 | $5.0 \times 10^{10}$ |
| 71 | C71 | C71 | 31 | 11 | 34 | 0.20 | 0.20 | 1.0 | $6.0 \times 10^{10}$ |

(Sheet Feeding Durability Test of Electrophotographic Photosensitive Member)

The electrophotographic photosensitive members 1 to 78 and C1 to C71 for the sheet feeding durability test each were mounted on a laser beam printer made by Canon Inc. (trade name: LBP7200C), and a sheet feeding durability test was performed under a low temperature and low humidity (15° C./10% RH) environment to evaluate an image. In the sheet feeding durability test, a text image having a coverage rate of 2% was printed on a letter size sheet one by one in an intermittent mode, and 3000 sheets of the image were output.

Then, a sheet of a sample for image evaluation (halftone image of a one dot KEIMA pattern) was output every time when the sheet feeding durability test was started, after 1500 sheets of the image were output, and after 3000 sheets of the image were output.

The image was evaluated on the following criterion.

A: no image defects caused by occurrence of the leak are found in the image.

B: tiny black dots caused by occurrence of the leak are slightly found in the image.

C: large black dots caused by occurrence of the leak are clearly found in the image.

D: large black dots and short horizontal black stripes caused by occurrence of the leak are found in the image.

E: long horizontal black stripes caused by occurrence of the leak are found in the image.

The charge potential (dark potential) and the potential during exposure (bright potential) were measured after the sample for image evaluation was output at the time of starting the sheet feeding durability test and after outputting 3000 sheets of the image. The measurement of the potential was performed using one white solid image and one black solid image. The dark potential at the initial stage (when the sheet feeding durability test was started) was Vd, and the bright potential at the initial stage (when the sheet feeding durability test was started) was Vl. The dark potential after 3000 sheets of the image were output was Vd', and the bright potential after 3000 sheets of the image were output was Vl'. The difference between the dark potential Vd' after 3000 sheets of the image were output and the dark potential Vd at the initial stage, i.e., the amount of the dark potential to be changed ΔVd (=|Vd'|−|Vd|) was determined. Moreover, the difference between the bright potential Vl' after 3000 sheets of the image were output and the bright potential Vl at the initial stage, i.e., the amount of the bright potential to be changed ΔVl (=|Vl'|−|Vl|) was determined.

The result is shown in Tables 15 to 21.

TABLE 15

| Example | Electro-photographic photosensitive member | Leakage: When sheet feeding durability test is started | Leakage: When 1500 sheets of image are output | Leakage: When 3000 sheets of image are output | Amount of potential to be changed [V] ΔVd | Amount of potential to be changed [V] ΔVl |
|---|---|---|---|---|---|---|
| 1 | 1 | A | A | A | +10 | +10 |
| 2 | 2 | A | A | A | +10 | +25 |
| 3 | 3 | A | A | A | +8 | +30 |
| 4 | 4 | A | A | A | +8 | +15 |
| 5 | 5 | A | A | A | +10 | +15 |
| 6 | 6 | A | A | A | +5 | +15 |
| 7 | 7 | A | A | A | +5 | +15 |
| 8 | 8 | A | A | A | +10 | +20 |
| 9 | 9 | A | A | A | +12 | +30 |
| 10 | 10 | A | A | A | +12 | +20 |
| 11 | 11 | A | A | A | +10 | +30 |
| 12 | 12 | A | B | B | +10 | +15 |
| 13 | 13 | A | A | A | +10 | +15 |
| 14 | 14 | A | A | A | +10 | +15 |
| 15 | 15 | A | B | B | +10 | +15 |
| 16 | 16 | A | A | A | +8 | +15 |
| 17 | 17 | A | A | A | +8 | +30 |
| 18 | 18 | A | A | A | +10 | +15 |

TABLE 16

| Example | Electro-photographic photosensitive member | Leakage: When sheet feeding durability test is started | Leakage: When 1500 sheets of image are output | Leakage: When 3000 sheets of image are output | Amount of potential to be changed [V] ΔVd | Amount of potential to be changed [V] ΔVl |
|---|---|---|---|---|---|---|
| 19 | 19 | A | A | A | +12 | +30 |
| 20 | 20 | A | A | A | +10 | +15 |
| 21 | 21 | A | A | A | +12 | +15 |
| 22 | 22 | A | A | A | +10 | +15 |
| 23 | 23 | A | A | A | +10 | +20 |
| 24 | 24 | A | A | A | +12 | +30 |
| 25 | 25 | A | A | A | +12 | +15 |
| 26 | 26 | A | A | A | +10 | +30 |
| 27 | 27 | A | B | B | +12 | +15 |
| 28 | 28 | A | A | A | +13 | +15 |
| 29 | 29 | A | A | A | +15 | +18 |
| 30 | 30 | A | B | B | +14 | +15 |
| 31 | 31 | A | A | A | +12 | +35 |
| 32 | 32 | A | A | A | +10 | +20 |
| 33 | 33 | A | A | A | +12 | +15 |
| 34 | 34 | A | A | A | +10 | +15 |
| 35 | 35 | A | A | A | +10 | +20 |
| 36 | 36 | A | A | A | +15 | +35 |
| 37 | 37 | A | A | A | +12 | +15 |
| 38 | 38 | A | A | A | +10 | +38 |
| 39 | 39 | A | B | B | +12 | +15 |
| 40 | 40 | A | A | A | +13 | +15 |
| 41 | 41 | A | A | A | +12 | +15 |
| 42 | 42 | A | B | B | +14 | +15 |

TABLE 17

| Example | Electro-photographic photosensitive member | Leakage: When sheet feeding durability test is started | Leakage: When 1500 sheets of image are output | Leakage: When 3000 sheets of image are output | Amount of potential to be changed [V] ΔVd | Amount of potential to be changed [V] ΔVl |
|---|---|---|---|---|---|---|
| 43 | 43 | A | A | A | +10 | +10 |
| 44 | 44 | A | A | A | +10 | +25 |
| 45 | 45 | A | A | A | +8 | +30 |
| 46 | 46 | A | A | A | +8 | +15 |
| 47 | 47 | A | A | A | +10 | +15 |
| 48 | 48 | A | A | A | +5 | +15 |
| 49 | 49 | A | A | A | +5 | +15 |
| 50 | 50 | A | A | A | +10 | +20 |
| 51 | 51 | A | A | A | +12 | +30 |
| 52 | 52 | A | A | A | +12 | +20 |
| 53 | 53 | A | A | A | +10 | +30 |
| 54 | 54 | A | B | 8 | +10 | +15 |
| 55 | 55 | A | A | A | +10 | +15 |
| 56 | 56 | A | A | A | +10 | +15 |
| 57 | 57 | A | B | B | +10 | +15 |
| 58 | 58 | A | A | A | +8 | +15 |
| 59 | 59 | A | A | A | +8 | +30 |
| 60 | 60 | A | A | A | +10 | +15 |

TABLE 18

| Example | Electro-photographic photosensitive member | Leakage: When sheet feeding durability test is started | Leakage: When 1500 sheets of image are output | Leakage: When 3000 sheets of image are output | Amount of potential to be changed [V] ΔVd | Amount of potential to be changed [V] ΔVl |
|---|---|---|---|---|---|---|
| 61 | 61 | A | A | A | +12 | +15 |
| 62 | 62 | A | A | A | +12 | +25 |
| 63 | 63 | A | A | A | +8 | +30 |
| 64 | 64 | A | A | A | +10 | +15 |
| 65 | 65 | A | A | A | +10 | +15 |
| 66 | 66 | A | A | A | +8 | +20 |
| 67 | 67 | A | A | A | +8 | +20 |
| 68 | 68 | A | A | A | +10 | +24 |
| 69 | 69 | A | A | A | +15 | +30 |
| 70 | 70 | A | A | A | +15 | +25 |
| 71 | 71 | A | A | A | +10 | +30 |
| 72 | 72 | A | B | B | +8 | +15 |
| 73 | 73 | A | A | A | +8 | +15 |
| 74 | 74 | A | A | A | +10 | +15 |
| 75 | 75 | A | B | B | +10 | +15 |
| 76 | 76 | A | A | A | +10 | +15 |
| 77 | 77 | A | A | A | +10 | +15 |
| 78 | 78 | A | A | A | +12 | +15 |

TABLE 19

| Example | Electro-photographic photosensitive member | Leakage: When sheet feeding durability test is started | Leakage: When 1500 sheets of image are output | Leakage: When 3000 sheets of image are output | Amount of potential to be changed [V] ΔVd | Amount of potential to be changed [V] ΔVl |
|---|---|---|---|---|---|---|
| 1 | C1 | A | A | A | +30 | +80 |
| 2 | C2 | C | D | D | +8 | +25 |
| 3 | C3 | B | B | C | +12 | +30 |
| 4 | C4 | B | B | C | +12 | +30 |
| 5 | C5 | B | C | C | +12 | +25 |
| 6 | C6 | A | A | A | +28 | +100 |
| 7 | C7 | A | A | A | +15 | +80 |
| 8 | C8 | B | C | C | +12 | +30 |
| 9 | C9 | A | A | B | +14 | +60 |
| 10 | C10 | A | A | A | +30 | +85 |
| 11 | C11 | C | D | E | +8 | +22 |
| 12 | C12 | B | B | C | +12 | +30 |
| 13 | C13 | B | B | C | +12 | +30 |
| 14 | C14 | B | B | C | +12 | +25 |
| 15 | C15 | A | A | A | +28 | +100 |
| 16 | C16 | A | A | A | +15 | +80 |
| 17 | C17 | B | C | C | +12 | +30 |
| 18 | C18 | A | A | B | +14 | +60 |
| 19 | C19 | A | A | A | +30 | +100 |
| 20 | C20 | C | D | E | +10 | +20 |
| 21 | C21 | B | B | C | +12 | +35 |
| 22 | C22 | B | B | C | +12 | +40 |
| 23 | C23 | B | B | C | +12 | +40 |
| 24 | C24 | A | A | A | +25 | +100 |
| 25 | C25 | A | A | A | +15 | +70 |
| 26 | C26 | B | C | C | +12 | +35 |
| 27 | C27 | A | A | B | +14 | +60 |

TABLE 20

| Comparative Example | Electro-photographic photosensitive member | Leakage: When sheet feeding durability test is started | Leakage: When 1500 sheets of image are output | Leakage: When 3000 sheets of image are output | Amount of potential to be changed [V] ΔVd | Amount of potential to be changed [V] ΔVl |
|---|---|---|---|---|---|---|
| 28 | C28 | B | B | C | +12 | +35 |
| 29 | C29 | B | B | C | +12 | +35 |
| 30 | C30 | B | B | C | +12 | +30 |
| 31 | C31 | B | C | C | +8 | +25 |
| 32 | C32 | B | B | C | +15 | +35 |
| 33 | C33 | B | B | C | +20 | +40 |
| 34 | C34 | B | B | C | +12 | +30 |
| 35 | C35 | B | B | C | +12 | +30 |
| 36 | C36 | B | B | C | +12 | +30 |
| 37 | C37 | B | B | C | +12 | +30 |
| 38 | C38 | A | B | C | +12 | +35 |
| 39 | C39 | A | B | C | +12 | +35 |
| 40 | C40 | A | B | C | +12 | +30 |
| 41 | C41 | A | B | C | +8 | +25 |
| 42 | C42 | A | B | C | +15 | +40 |
| 43 | C43 | A | B | C | +20 | +60 |
| 44 | C44 | A | B | C | +12 | +30 |
| 45 | C45 | A | B | C | +12 | +30 |
| 46 | C46 | A | B | C | +12 | +30 |
| 47 | C47 | A | B | C | +12 | +30 |
| 48 | C48 | A | B | B | +10 | +15 |
| 49 | C49 | A | B | B | +10 | +25 |
| 50 | C50 | A | B | C | +15 | +30 |
| 51 | C51 | A | B | B | +10 | +20 |
| 52 | C52 | A | B | B | +10 | +20 |
| 53 | C53 | B | C | C | +20 | +50 |

TABLE 21

| Comparative Example | Electro-photographic photosensitive member | Leakage: When sheet feeding durability test is started | Leakage: When 1500 sheets of image are output | Leakage: When 3000 sheets of image are output | Amount of potential to be changed [V] ΔVd | Amount of potential to be changed [V] ΔVl |
|---|---|---|---|---|---|---|
| 54 | C54 | A | A | A | +30 | +80 |
| 55 | C55 | C | D | D | +8 | +25 |
| 56 | C56 | B | B | C | +12 | +30 |
| 57 | C57 | B | B | C | +12 | +30 |
| 58 | C58 | B | C | C | +12 | +25 |
| 59 | C59 | A | A | A | +28 | +100 |
| 60 | C60 | A | A | A | +15 | +80 |
| 61 | C61 | B | B | C | +12 | +30 |
| 62 | C62 | A | A | B | +14 | +60 |
| 63 | C63 | A | A | A | +35 | +85 |
| 64 | C64 | C | D | E | +10 | +22 |
| 65 | C65 | B | B | C | +12 | +35 |
| 66 | C66 | B | B | C | +12 | +35 |
| 67 | C67 | B | B | C | +15 | +25 |
| 68 | C68 | A | A | A | +30 | +110 |
| 69 | C69 | A | A | A | +20 | +80 |
| 70 | C70 | B | C | C | +15 | +30 |
| 71 | C71 | A | A | B | +18 | +70 |

(Probe Pressure Resistance Test of Electrophotographic Photosensitive Member)

The electrophotographic photosensitive members for the probe pressure resistance test 101 to 178 and C101 to C171 were subjected to a probe pressure resistance test as follows.

Figure 2:
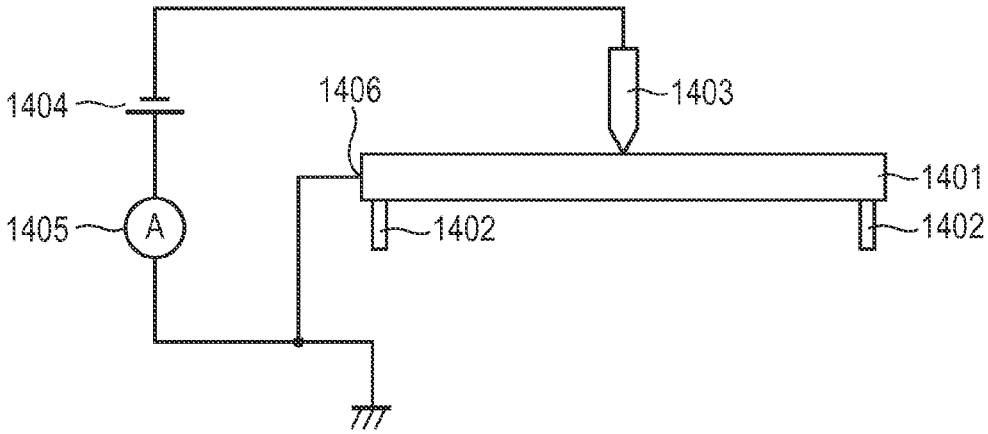
FIG. 2 is a drawing illustrating an example of a probe pressure resistance test apparatus.

A probe pressure resistance test apparatus is illustrated in FIG. 2. The probe pressure resistance test was performed under a normal temperature and normal humidity (23° C./50% RH) environment.

Both ends of an electrophotographic photosensitive member 1401 were placed on fixing bases 1402, and fixed such that the electrophotographic photosensitive member did not move. The tip of a probe electrode 1403 was brought into contact with the surface of the electrophotographic photosensitive member 1401. To the probe electrode 1403, a power supply 1404 for applying voltage and an ammeter 1405 for measuring current were connected. A portion 1406 of the electrophotographic photosensitive member 1401 contacting the support was connected to a ground. The voltage applied for 2 seconds by the probe electrode 1403 was increased from 0 V in increments of 10 V. The probe pressure resistance value was defined as the voltage when the leak occurred inside of the electrophotographic photosensitive member 1401 contacted by the tip of the probe electrode 1403 and the value indicated by the ammeter 1405 started to be 10 times or more larger. This measurement was performed on five points of the surface of the electrophotographic photosensitive member 1401, and the average value was defined as the probe pressure resistance value of the electrophotographic photosensitive member 1401 to be measured.

The results are shown in Tables 22 to 24.

TABLE 22

| Example | Electrophotographic photosensitive member | Probe pressure resistance value [−V] |
|---|---|---|
| 1 | 101 | 4000 |
| 2 | 102 | 4500 |
| 3 | 103 | 4500 |
| 4 | 104 | 4000 |
| 5 | 105 | 4300 |
| 6 | 106 | 3800 |
| 7 | 107 | 4300 |
| 8 | 108 | 4800 |
| 9 | 109 | 4800 |
| 10 | 110 | 4500 |
| 11 | 111 | 4500 |
| 12 | 112 | 3200 |
| 13 | 113 | 4000 |
| 14 | 114 | 4500 |
| 15 | 115 | 3300 |
| 16 | 116 | 4000 |
| 17 | 117 | 4500 |
| 18 | 118 | 4300 |
| 19 | 119 | 4700 |
| 20 | 120 | 4000 |
| 21 | 121 | 4300 |
| 22 | 122 | 3800 |
| 23 | 123 | 4800 |
| 24 | 124 | 4800 |
| 25 | 125 | 4500 |
| 26 | 126 | 4500 |
| 27 | 127 | 3300 |
| 28 | 128 | 4500 |
| 29 | 129 | 4400 |
| 30 | 130 | 3500 |
| 31 | 131 | 4700 |
| 32 | 132 | 4400 |
| 33 | 133 | 4300 |
| 34 | 134 | 3800 |
| 35 | 135 | 4500 |
| 36 | 136 | 4500 |
| 37 | 137 | 4300 |
| 38 | 138 | 4500 |
| 39 | 139 | 3200 |
| 40 | 140 | 4400 |

TABLE 22-continued

| Example | Electrophotographic photosensitive member | Probe pressure resistance value [−V] |
|---|---|---|
| 41 | 141 | 4500 |
| 42 | 142 | 3400 |

TABLE 23

| Example | Electrophotographic photosensitive member | Probe pressure resistance value [−V] |
|---|---|---|
| 43 | 143 | 4000 |
| 44 | 144 | 4500 |
| 45 | 145 | 4500 |
| 46 | 146 | 4100 |
| 47 | 147 | 4300 |
| 48 | 148 | 3700 |
| 49 | 149 | 4200 |
| 50 | 150 | 4700 |
| 51 | 151 | 4700 |
| 52 | 152 | 4500 |
| 53 | 153 | 4500 |
| 54 | 154 | 3200 |
| 55 | 155 | 4100 |
| 56 | 156 | 4400 |
| 57 | 157 | 3400 |
| 58 | 158 | 3900 |
| 59 | 159 | 4500 |
| 60 | 160 | 4200 |
| 61 | 161 | 3900 |
| 62 | 162 | 4400 |
| 63 | 163 | 4500 |
| 64 | 164 | 4000 |
| 65 | 165 | 4200 |
| 66 | 166 | 3700 |
| 67 | 167 | 4200 |
| 68 | 168 | 4700 |
| 69 | 169 | 4700 |
| 70 | 170 | 4300 |
| 71 | 171 | 4300 |
| 72 | 172 | 3000 |
| 73 | 173 | 4000 |
| 74 | 174 | 4500 |
| 75 | 175 | 3300 |
| 76 | 176 | 4000 |
| 77 | 177 | 4500 |
| 78 | 178 | 4200 |

TABLE 24

| Example | Electro photo-graphic photo-sensitive member | Probe pressure resistance value [−V] |
|---|---|---|
| 1 | C101 | 3800 |
| 2 | C102 | 1500 |
| 3 | C103 | 2500 |
| 4 | C104 | 2500 |
| 5 | C105 | 2500 |
| 6 | C106 | 4000 |
| 7 | C107 | 3600 |
| 8 | C108 | 2500 |
| 9 | C109 | 3800 |
| 10 | C110 | 3800 |
| 11 | C111 | 1500 |
| 12 | C112 | 2500 |

TABLE 24-continued

| Example | Electro photo-graphic photo-sensitive member | Probe pressure resistance value [−V] |
|---|---|---|
| 13 | C113 | 2600 |
| 14 | C114 | 2700 |
| 15 | C115 | 4000 |
| 16 | C116 | 3800 |
| 17 | C117 | 2500 |
| 18 | C118 | 3800 |
| 19 | C119 | 4000 |
| 20 | C120 | 1500 |
| 21 | C121 | 2500 |
| 22 | C122 | 2600 |
| 23 | C123 | 2700 |
| 24 | C124 | 4000 |
| 25 | C125 | 3800 |
| 26 | C126 | 2500 |
| 27 | C127 | 3800 |
| 28 | C128 | 2500 |
| 29 | C129 | 2200 |
| 30 | C130 | 2300 |
| 31 | C131 | 2000 |
| 32 | C132 | 2500 |
| 33 | C133 | 2500 |
| 34 | C134 | 2200 |
| 35 | C135 | 2200 |
| 36 | C136 | 2200 |
| 37 | C137 | 2200 |
| 38 | C138 | 2900 |
| 39 | C139 | 2800 |
| 40 | C140 | 2900 |
| 41 | C141 | 2500 |
| 42 | C142 | 3000 |
| 43 | C143 | 3000 |
| 44 | C144 | 2900 |
| 45 | C145 | 2900 |
| 46 | C146 | 2800 |
| 47 | C147 | 2700 |
| 48 | C148 | 2500 |
| 49 | C149 | 2800 |
| 50 | C150 | 2000 |
| 51 | C151 | 2500 |
| 52 | C152 | 2300 |
| 53 | C153 | 2500 |
| 54 | C154 | 3800 |
| 55 | C155 | 1500 |
| 56 | C156 | 2500 |
| 57 | C157 | 2500 |
| 58 | C158 | 2500 |
| 59 | C159 | 4000 |
| 60 | C160 | 3600 |
| 61 | C161 | 2500 |
| 62 | C162 | 3800 |
| 63 | C163 | 3700 |
| 64 | C164 | 1500 |
| 65 | C165 | 2400 |
| 66 | C166 | 2600 |
| 67 | C167 | 2600 |
| 68 | C168 | 3900 |
| 69 | C169 | 3400 |
| 70 | C170 | 2500 |
| 71 | C171 | 3800 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2012-189530, filed Aug. 30, 2012, and 2013-077620, filed Apr. 3, 2013, which are hereby incorporated by reference herein in their entirety.

REFERENCE SIGNS LIST

1 Electrophotographic photosensitive member
2 Shaft
3 Charging unit (primary charging unit)
4 Exposure light (image exposure light)
5 Developing unit
6 Transfer unit (such as transfer roller)
7 Cleaning unit (such as cleaning blade)
8 Fixing unit
9 Process cartridge
10 Guide unit
11 Pre-exposure light
P Transfer material (such as paper)

The invention claimed is:

1. An electrophotographic photosensitive member comprising:

a support, a conductive layer formed on the support, and a photosensitive layer formed on the conductive layer, wherein, the conductive layer comprises:

a binder material, a first metal oxide particle, and a second metal oxide particle, the first metal oxide particle is a titanium oxide particle coated with tin oxide doped with phosphorus, tungsten, niobium, tantalum, or fluorine, the second metal oxide particle is an uncoated titanium oxide particle, a content of the first metal oxide particle in the conductive layer is not less than 20% by volume and not more than 50% by volume based on a total volume of the conductive layer, and a content of the second metal oxide particle in the conductive layer is not less than 1.0% by volume and not more than 15% by volume based on the total volume of the conductive layer, and not less than 5.0% by volume and not more than 30% by volume based on the content of the first metal oxide particle in the conductive layer.

2. The electrophotographic photosensitive member according to claim 1, wherein the content of the second metal oxide particle in the conductive layer is not less than 5.0% by volume and not more than 20% by volume based on the content of the first metal oxide particle in the conductive layer.

3. The electrophotographic photosensitive member according to claim 1, wherein a ratio ($D_1/D_2$) of an average primary particle diameter ($D_1$) of the first metal oxide particle to an average primary particle diameter ($D_2$) of the second metal oxide particle in the conductive layer is not less than 0.7 and not more than 1.3.

4. A process cartridge that integrally supports the electrophotographic photosensitive member according to claim 1 and at least one selected from the group consisting of a charging unit, a developing unit, a transfer unit, and a cleaning unit, and is detachably mountable on a main body of an electrophotographic apparatus.

5. An electrophotographic apparatus comprising the electrophotographic photosensitive member according to claim 1, a charging unit, an exposing unit, a developing unit, and a transfer unit.

* * * * *